US010067435B2

(12) United States Patent
Kawamura et al.

(10) Patent No.: US 10,067,435 B2
(45) Date of Patent: Sep. 4, 2018

(54) ELECTROSTATIC CHARGE IMAGE DEVELOPING TONER

(71) Applicant: Konica Minolta, Inc., Tokyo (JP)

(72) Inventors: Takaki Kawamura, Hino (JP); Shiro Hirano, Hachioji (JP); Yusuke Takigaura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/787,072

(22) Filed: Oct. 18, 2017

(65) Prior Publication Data

US 2018/0129146 A1 May 10, 2018

(30) Foreign Application Priority Data

Nov. 9, 2016 (JP) ..... 2016-218737

(51) Int. Cl.
*G03G 9/087* (2006.01)
*G03G 9/08* (2006.01)

(52) U.S. Cl.
CPC ..... *G03G 9/08755* (2013.01); *G03G 9/0823* (2013.01); *G03G 9/0825* (2013.01); *G03G 9/08702* (2013.01); *G03G 9/08797* (2013.01)

(58) Field of Classification Search
CPC ..... G03G 9/08797; G03G 9/08755; G03G 9/08706; G03G 9/08708; G03G 9/08711
See application file for complete search history.

(56) References Cited

U.S. PATENT DOCUMENTS

2014/0287354 A1* 9/2014 Kawamura ..... G03G 9/0825 430/109.3

FOREIGN PATENT DOCUMENTS

JP 2001222138 A 8/2001
JP 2016066017 A 4/2016

* cited by examiner

*Primary Examiner* — Peter L Vajda
(74) *Attorney, Agent, or Firm* — Lucas & Mercanti, LLP

(57) ABSTRACT

An electrostatic charge image developing toner includes a particulate toner matrix containing a binder resin and an external additive. The binder resin includes an amorphous polyester resin, a crystalline resin, and an amorphous vinyl resin. A storage modulus $G'_0(t)$ measured before the toner is left and storage moduli $G'_{Tm-10}(t)$ and $G'_{Tm-20}(t)$ measured after the toner is left for three hours at temperatures $(T_m-10)°$ C. and $(T_m-20)°$ C., respectively, based on a melting point ($T_m$° C.) derived from the crystalline resin satisfy the relations represented by $G'_0(t)<G'_{Tm-10}(t)$, $G'_0(t)<G'_{Tm-20}(t)$, and $G'_{Tm-10}(x)/G'_{Tm-20}(x)\leq 1.5$ in a temperature range A for measurement where the storage modulus $G'_0(t)$ is $1.0\times10^6$ Pa or more. The value t represents any temperature (° C.) for measurement in the temperature range A for measurement; and the value x represents the temperature (° C.) for measurement having a maximum difference between the storage moduli $G'_{Tm-10}(t)$ and $G'_{Tm-20}(t)$.

13 Claims, 2 Drawing Sheets

ELECTROSTATIC CHARGE IMAGE DEVELOPING TONER

CROSS-REFERENCE TO RELATED APPLICATIONS

This application claims a priority under the Paris Convention of Japanese Patent Application No. 2016-218737 filed on Nov. 9, 2016, the entire disclosure of which is incorporated herein by reference in its entirety.

BACKGROUND

1. Technological Field

The present invention relates to an electrostatic charge image developing toner. More specifically, the present invention relates to an electrostatic charge image developing toner containing a crystalline resin, the toners having superior low-temperature fixing characteristics and heat-resistant storage characteristics, and having stable low-temperature fixing characteristics and reduced bleed-out of the crystalline material during long-term storage of the toner at high temperature.

2. Description of the Related Art

Recent electrophotographic image forming apparatuses have required an electrostatic charge image developing toner (hereinafter, also simply referred to as "toner") thermally fixed at lower temperature (hereinafter, also referred to as "low-temperature fixing") to achieve a high print rate and further energy saving for reducing environmental loads. Such a toner should contain a binder resin having a low melting temperature and low melt viscosity. For this reason, a toner is disclosed which contains a crystalline resin, such as a crystalline polyester resin, and has improved low-temperature fixing characteristics (see Japanese Patent Application Laid-Open Publication No. 2001-222138, for example). If the toner containing a crystalline resin is heated to a temperature higher than the melting point of the crystalline resin during preparation of the toner, the crystalline resin is undesirably blended with an amorphous resin, reducing the heat-resistant storage characteristics of the toner.

Annealing is a known means of improving the heat-resistant storage characteristics of such a toner containing a crystalline resin. For example, Japanese Patent Application Laid-Open Publication No. 2016-066017 reports that annealing of the toner at a temperature equal to or lower than the softening temperature of the toner for a long time causes recrystallization of the blended crystalline resin, improving the heat-resistant storage characteristics of the toner. Although the heat resistance is enhanced, the diameter of the crystalline resin domain in the toner is increased to expose the crystalline resin from the surfaces of toner particles. The exposed crystalline resin reduces the surface resistance of the toner particles, reducing the charging characteristics of the toner. The reduced charging characteristics result in failures, such as scattering of the toner.

In the toner containing the crystalline resin insufficiently crystallized during long-term annealing of the toner, further crystallization of the crystalline resin in the toner product after shipping will progress during storage of the toner product at high temperature (for example, in the range of 50 to 60° C.), thus reducing the low-temperature fixing characteristics of the toner. In other words, the toner containing the crystalline resin requires stable low-temperature fixing characteristics and reduced bleed-out of the crystalline resin during storage in or exposure to severe environments (under environments at high temperature).

In the toner containing a crystalline material and having high low-temperature fixing characteristics, an amorphous resin is plasticized by the crystalline material, impairing the heat resistance of the toner. Low heat resistance may result in the aggregation of the toner stored under heat in a developing unit. The toner having these characteristics precludes the compatibility between the low-temperature fixing characteristics and the heat-resistant storage characteristics in some cases.

SUMMARY

The present invention has been made in consideration of the problems and the circumstances described above. An object of the present invention is to provide an electrostatic charge image developing toner containing a crystalline resin, the toner having superior low-temperature fixing characteristics and heat-resistant storage characteristics, and having stable low-temperature fixing characteristics and reduced bleed-out of a crystalline material during long-term storage of the toner at high temperature.

The present inventor, who has conducted extensive research about the causes of the problems to solve the problems, has found that if the storage modulus of a toner containing a crystalline resin is specified in a range of specific temperature measured after storage of the toner at a specific temperature based on the melting point derived from the crystalline resin, an electrostatic charge image developing toner having superior low-temperature fixing characteristics and heat-resistant storage characteristics, and having stable low-temperature fixing characteristics of the toner and reduced bleed-out of the crystalline material during long-term storage of the toner at high temperature can be provided, and has achieved the present invention.

In other words, the problems of the present invention are solved by the following methods.

To achieve at least one of the abovementioned objects, according to an aspect of the present invention, there is provided an electrostatic charge image developing toner including:

a particulate toner matrix containing a binder resin, and an external additive, wherein the binder resin comprises an amorphous polyester resin, a crystalline resin, and an amorphous vinyl resin, and a storage modulus $G'_0(t)$ measured before the toner is left and storage moduli $G'_{Tm-10}(t)$ and $G'_{Tm-20}(t)$ measured after the toner is left for three hours at temperatures $(T_m-10)$° C. and $(T_m-20)$° C., respectively, based on a melting point ($T_m$° C.) derived from the crystalline resin satisfy the relations represented by Expressions (1a), (1b), and (2a) in a temperature range A for measurement where the storage modulus $G'_0(t)$ is $1.0\times10^6$ Pa or more:

$$G'_0(t)<G'_{Tm-10}(t) \quad \text{Expression (1a):}$$

$$G'_0(t)<G'_{Tm-20}(t) \quad \text{Expression (1b):}$$

$$G'_{Tm-10}(x)/G'_{Tm-20}(x)\leq1.5 \quad \text{Expression (2a):}$$

where t represents any temperature (° C.) for measurement in the temperature range A for measurement; and x represents the temperature (° C.) for measurement having a maximum difference between the storage moduli $G'_{Tm-10}(t)$ and $G'_{Tm-20}(t)$.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1A:
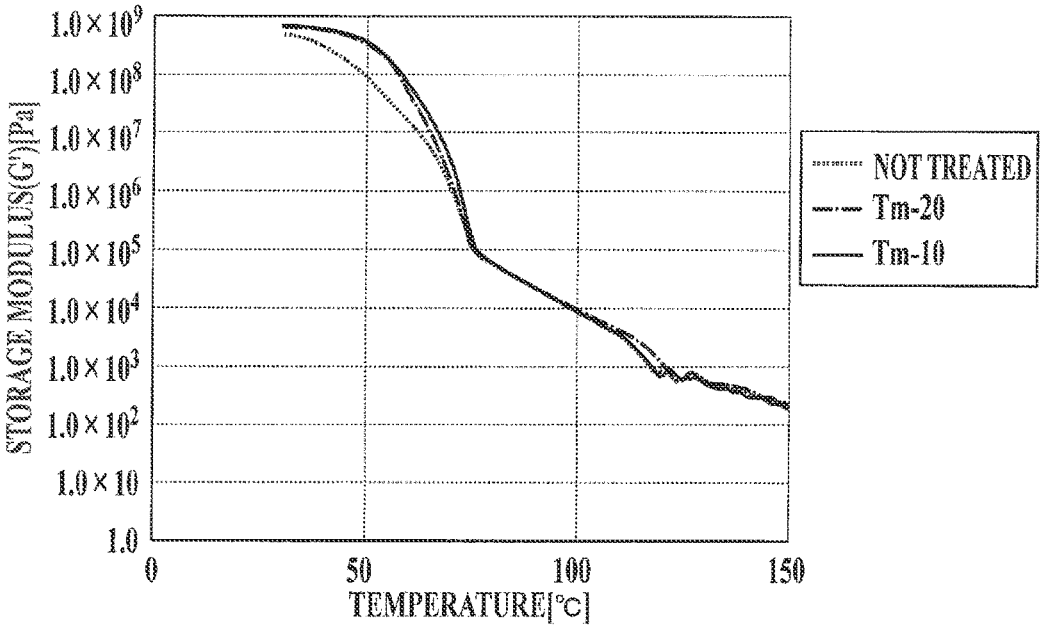
FIG. 1A is a schematic view illustrating the relation between the storage modulus of the toner according to the present invention and the temperature.

Hereinafter, one or more embodiments of the present invention will be described with reference to the drawings. However, the scope of the invention is not limited to the disclosed embodiments.

As described above, in the toner containing a crystalline material and having superior low-temperature fixing characteristics, the amorphous resin is plasticized by the crystalline material, reducing the heat resistance of the toner. Such low heat resistance may result in the aggregation of the toner stored under heat in a developing unit, precluding the compatibility between the low-temperature fixing characteristics and the heat-resistant storage characteristics in some cases.

The present inventor, however, has found that a crystalline resin and an amorphous resin having polarities appropriately controlled can increase the storage modulus G' of the toner stored under a high temperature environment at a temperature equal to or lower than the softening temperature of the toner. This is probably because the blended crystalline resin is crystallized to lose the effect of plasticization of the amorphous resin; as a result, the glass transition temperature Ts of the toner increases.

Furthermore, the present inventor has found that this incompatibilization of the crystalline resin is facilitated through optimization of the material composition so as to satisfy the relations represented by Expressions (1a), (1b), and (2a). Such a material composition can enhance crystallization (that is, suppress compatibilization) of the crystalline resin at both of temperatures "melting point ($T_m$° C.) derived from the crystalline resin)−10° C." and "(melting point ($T_m$° C.) derived from the crystalline resin)−20° C.". For this reason, a variation in low-temperature fixing characteristics does not occur in the toner irrespective of different storage temperatures including high temperatures, reducing the fluctuation in low-temperature fixing characteristics of the toner. Accordingly, the toner can have the compatibility between the low-temperature fixing characteristics and the heat-resistant storage characteristics irrespective of different storage temperatures.

Expression (2a) indicates a small variation in viscoelasticity (storage modulus) caused by the difference in temperature during storage of the toner under heat. In other words, Expression (2a) indicates that the toner has sufficiently high viscoelasticity at low temperature, and thus high efficiency of incompatibilization. The incompatibilization can be saturated at both of high and low temperatures, and a fluctuation in fixing characteristics can be reduced without varying the fixing characteristics of the toner stored at different high temperatures.

The variation in viscoelasticity (storage modulus) at different temperatures is represented by Expression ($G'_{Tm-10}(x)/G'_{Tm-20}(x)$). A variation of more than 1.5 results in an increased change in size of the crystals composed of the crystalline material present in the particulate toner matrix, exposing the crystalline material from the surface of the particulate toner matrix during storage at high temperature (hereinafter, this phenomenon is also referred to as "bleed-out" or "B.O."). The change in crystal size can be reduced if the relation represented by Expression (2a) is satisfied, reducing the bleed-out of the crystalline material.

Examples of the means of satisfying the relation represented by Expression (2a) include use of an acrylate monomer having a long-chain linear moiety having a structure similar to that of the crystalline resin (the linear moiety preferably has 6 or more carbon atoms; specifically, a 2-ethylhexyl acrylate monomer, for example) to facilitate the crystallization of the crystalline resin and reduce the compatibilization thereof.

Alternatively, a small amount of mold release agent having a melting point higher than that of the crystalline resin may be added. The mold release agent can serve as a nucleus for the origin of crystallization to facilitate an enhancement in crystallinity.

The differences between the techniques in the present invention and conventional techniques are summarized below.

Figure 1B:
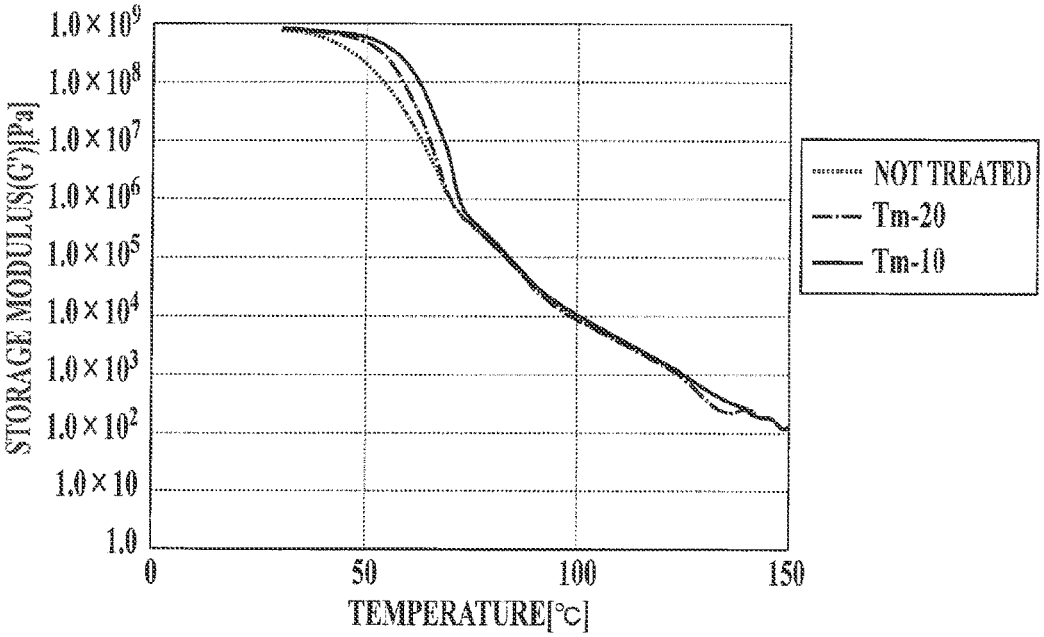
FIG. 1B is a schematic view illustrating the relation between the storage modulus of a conventional toner and the temperature.

It is found that annealing of the toner containing a crystalline resin at a temperature equal to or lower than the melting point ($T_m$° C.) derived from the crystalline resin contained in the toner facilitates the crystallization of the crystalline resin to increase the storage modulus of the toner. In the present invention, the storage modulus is controlled such that the storage modulus increases equally over a wide range of temperature. For example, FIG. 1A illustrates variations in storage moduli of the toner according to the present invention that is heated to temperatures ($T_m$−10)° C. and ($T_m$−20)° C., in other words, stored at high temperatures. In FIG. 1A, compared to the toner not stored at high temperature, the storage modulus remains substantially invariable and the storage modulus at lower temperature is higher in the toner stored at high temperatures. FIG. 1B illustrates an example toner prepared by a conventional technique, showing that the storage modulus is higher at higher temperature in the toner stored at high temperatures ($T_m$−10)° C. and ($T_m$−20)° C. compared to the toner not stored at high temperature. The toner according to the present invention has the storage modulus illustrated in FIG. 1A.

The electrostatic charge image developing toner according to the present invention comprises a particulate toner matrix containing a binder resin, and an external additive, wherein the binder resin comprises an amorphous polyester resin, a crystalline resin, and an amorphous vinyl resin, and a storage modulus $G'_0(t)$ measured before the toner is left and storage moduli $G'_{Tm-10}(t)$ and $G'_{Tm-20}(t)$ measured after the toner is left for three hours at temperatures ($T_m$−10)° C. and ($T_m$−20)° C., respectively, based on the melting point ($T_m$° C.) derived from the crystalline resin satisfy the relations represented by Expressions (1a), (1b), and (2a) in a temperature range A for measurement where the storage modulus $G'_0(t)$ is $1.0\times10^6$ Pa or more. Such a concept is a technical feature common to the claimed inventions. According to such a configuration, the electrostatic charge image developing toner of the present invention containing a crystalline resin can have superior low-temperature fixing characteristics and heat-resistant storage characteristics, and have stable low-temperature fixing characteristics and reduced bleed-out of the crystalline material during long-term storage of the toner at high temperature.

In one aspect of the present invention, the content of the crystalline resin in the total amount of the amorphous polyester resin and the crystalline resin is preferably more than 40 mass % and 60 mass % or less. A content of the crystalline resin within this range can improve the low-temperature fixing characteristics and heat resistance of the toner.

In the present invention, the content of the amorphous vinyl resin in the binder resin is preferably 50 mass % or more. A content of the amorphous vinyl resin within this range can favorably stabilize the low-temperature fixing characteristics of the toner and reduce the bleed-out of the crystalline material during long-term storage of the toner at high temperature.

In the present invention, the storage moduli $G'_0(t)$, $G'_{Tm-10}(t)$, and $G'_{Tm-20}(t)$ preferably satisfy the relations represented by Expressions (3a) and (3b) in the temperature range A for measurement where the storage modulus $G'_0(t)$ is $1.0\times10^6$ Pa or more. Such storage moduli can further improve the heat-resistant storage characteristics of the toner, and can suitably reduce the bleed-out of the crystalline material.

In the present invention, the storage moduli $G'_0(t)$, $G'_{Tm-10}(t)$, and $G'_{Tm-20}(t)$ preferably satisfy the relations represented by Expressions (4a) and (4b) where temperatures at which the storage moduli $G'_0(t)$, $G'_{Tm-10}(t)$, and $G'_{Tm-20}(t)$ are $1.0\times10^6$ Pa are defined as $t_0$° C., $t_1$° C., and $t_2$° C., respectively. Such storage moduli are preferred because the fluctuation in low-temperature fixing characteristics of the toner can be preferably reduced during long-term storage of the toner at high temperature.

In the present invention, storage moduli at temperatures having a maximum difference between the storage modulus $G'_{Tm-10}(t)$ and the storage modulus $G'_0(t)$ and a maximum difference between the storage modulus $G'_{Tm-20}(t)$ and the storage modulus $G'_0(t)$ are preferably in the range of $1.0\times10^8$ to $3.0\times10^8$ Pa in the temperature range A for measurement where the storage modulus $G'_0(t)$ is $1.0\times10^6$ Pa or more. Such storage moduli are preferred because the toner can have further improved heat-resistant storage characteristics while keeping the low-temperature fixing characteristics.

In the present invention, Expression $(G'_{Tm-10}(x)/G'_{Tm-20}(x))$ in the left side of Expression (2a) preferably satisfies the relation represented by Expression (2b). In such a configuration, the heat-resistant storage characteristics of the toner are further improved, and the fluctuation in low-temperature fixing characteristics of the toner and the bleed-out of the crystalline material can be significantly reduced during long-term storage of the toner at high temperature.

In the present invention, Expression $(G'_{Tm-10}(x)/G'_{Tm-20}(x))$ in the left side of Expression (2a) preferably satisfies the relation represented by Expression (2c). In such a configuration, the heat-resistant storage characteristics of the toner are further improved, and the fluctuation in low-temperature fixing characteristics of the toner and the bleed-out of the crystalline material can be further reduced during long-term storage of the toner at different temperatures, such as high temperature.

In the present invention, the particulate toner matrix preferably has a core-shell structure. The core-shell structure can further improve the low-temperature fixing characteristics and heat-resistant storage characteristics of the toner.

In the present invention, the melting point $T_m$ is preferably in the range of 55 to 80° C. A crystalline resin having a melting point within this range can further improve the low-temperature fixing characteristics and heat-resistant storage characteristics of the toner.

In the present invention, the content of the crystalline resin in the particulate toner matrix is preferably in the range of 5 to 20 mass %. Such a content can further improve the low-temperature fixing characteristics and heat-resistant storage characteristics of the toner.

In the present invention, the crystalline resin comprises preferably a crystalline polyester resin. A crystalline polyester resin can further improve the low-temperature fixing characteristics of the toner.

In the present invention, the crystalline polyester resin comprises preferably a hybrid crystalline polyester resin of at least a crystalline polyester polymer segment and a different polymer segment that are chemically bonded. Such a hybrid crystalline polyester resin can suitably control the compatibilization, incompatibilization, or crystallization of the binder resin and the mold release agent contained in the particulate toner matrix, thus suitably achieving the advantageous effects of the present invention.

The present invention and its constituent and embodiments for achieving the present invention will now be described in detail. Throughout the specification "to" between two numerical values indicates the lower limit includes the numeric value before "to" and the upper limit includes the numeric value after "to".

<<Outline of Electrostatic Charge Image Developing Toner>>

The electrostatic charge image developing toner according to the present invention comprises a particulate toner matrix containing a binder resin, and an external additive, wherein the binder resin comprises an amorphous polyester resin, a crystalline resin, and an amorphous vinyl resin, and a storage modulus $G'_0(t)$ measured before the toner is left and storage moduli $G'_{Tm-10}(t)$ and $G'_{Tm-20}(t)$ measured after the toner is left for three hours at temperatures $(T_m-10)$° C. and $(T_m-20)$° C., respectively, based on the melting point ($T_m$° C.) derived from the crystalline resin satisfy the relations represented by Expressions (1a), (1b), and (2a) in a temperature range A for measurement where the storage modulus $G'_0(t)$ is $1.0\times10^6$ Pa or more.

$$G'_0(t)<G'_{Tm-10}(t) \quad \text{Expression (1a):}$$

$$G'_0(t)<G'_{Tm-20}(t) \quad \text{Expression (1b):}$$

$$G'_{Tm-10}(x)/G'_{Tm-20}(x)\leq1.5 \quad \text{Expression (2a):}$$

where t represents any temperature (° C.) for measurement in the temperature range A for measurement; and x represents the temperature (° C.) for measurement having a maximum difference between the storage moduli $G'_{Tm-10}(t)$ and $G'_{Tm-20}(t)$.

In the present invention, in the temperature range A for measurement, the storage modulus $G'_0(t)$ measured before the toner is left under an environment at $(T_m-10)$° C. or $(T_m-20)$° C. is $1.0\times10^6$ Pa or more.

The maximum difference between the storage moduli $G'_{Tm-10}(t)$ and $G'_{Tm-20}(t)$ indicates the maximum ratio $(G'_{Tm-10}(t)/G'_{Tm-20}(t))$.

The storage moduli $G'_0(t)$, $G'_{Tm-10}(t)$, and $G'_{Tm-20}(t)$ preferably satisfy the relations represented by Expressions (3a) and (3b) in the temperature range A for measurement where the storage modulus $G'_0(t)$ is $1.0\times10^6$ Pa or more.

$$1<(G'_{Tm-10}(t)/G'_0(t))\leq 10 \quad \text{Expression (3a):}$$

$$1<(G'_{Tm-20}(t)/G'_0(t))\leq 10 \quad \text{Expression (3b):}$$

It is believed that if the storage moduli $G'_0(t)$, $G'_{Tm-10}(t)$, and $G'_{Tm-20}(t)$ satisfy the relations represented by Expressions (3a) and (3b), an increase in storage modulus occurs with a predetermined or larger width during storage of the toner at high temperature, further enhancing the heat-resistant storage characteristics of the toner. If the ratio ($G'_{Tm-10}(t)/G'_0(t)$) or ($G'_{Tm-20}(t)/G'_0(t)$) is as small as 10 or less in the increase in storage modulus, excessive incompatibilization of crystals inside the particulate toner matrix can be avoided even during storage of the toner at high temperature, suitably reducing the bleed-out of the crystalline material.

It should be noted that the crystalline material in the present invention includes a mold release agent and a crystalline resin.

The storage moduli $G'_0(t)$, $G'_{Tm-10}(t)$, and $G'_{Tm-20}(t)$ preferably satisfy the relations represented by Expressions (4a) and (4b) where temperatures at which the storage moduli $G'_0(t)$, $G'_{Tm-10}(t)$, and $G'_{Tm-20}(t)$ is $1.0\times10^6$ Pa are defined as $t_0$° C., $t_1$° C., and $t_2$° C., respectively:

$$|t_0-t_1|\leq 2^\circ \text{ C.} \quad \text{Expression (4a):}$$

$$|t_0-t_2|\leq 2^\circ \text{ C.} \quad \text{Expression (4b):}$$

It is believed that even if the toner is heated at different temperatures (stored at high temperature) having a difference of 10° C., the low-temperature fixing characteristics of the toner remain identical through control of the temperatures $t_0$° C., $t_1$° C., and $t_2$° C. at which the storage modulus is $1.0\times10^6$ Pa (believed to be related to the low-temperature fixing characteristics) such that the absolute difference between the temperature $t_0$° C. and the temperature $t_1$° C. and the absolute difference between the temperature $t_0$° C. and the temperature $t_2$° C. fall within 2° C. or less as represented by Expressions (4a) and (4b). Accordingly, storage moduli satisfying the relations represented by Expressions (4a) and (4b) can achieve a toner keeping favorable low-temperature fixing characteristics during storage of the toner at different temperatures including high temperature.

The storage moduli at temperatures having the maximum difference between the storage modulus $G'_{Tm-10}(t)$ and the storage modulus $G'_0(t)$ and the maximum difference between the storage modulus $G'_{Tm-20}(t)$ and the storage modulus $G'_0(t)$ are preferably in the range of $1.0\times10^8$ to $3.0\times10^8$ Pa in the temperature range A for measurement where the storage modulus $G'_0(t)$ is $1.0\times10^6$ Pa or more.

The storage moduli controlled in such a range in the temperature range A for measurement result in maximum increases in storage moduli in the temperature range such that the storage modulus of the toner before storage at high temperature increases in the range of $1.0\times10^8$ to $3.0\times10^8$ Pa after storage at high temperature (this temperature range is considered to be related to the heat resistance of the toner). The toner stored at high temperature can have further improved heat-resistant storage characteristics while keeping the low-temperature fixing characteristics.

The relation represented by Expression ($G'_{Tm-10}(x)/G'_{Tm-20}(x)$) in the left side of Expression (2a) preferably satisfies the relation represented by Expression (2b):

$$(G'_{Tm-10}(x)/G'_{Tm-20}(x))\leq 1.25 \quad \text{Expression (2b):}$$

The relation represented by Expression ($G'_{Tm-10}(x)/G'_{Tm-20}(x)$) in the left side of Expression (2a) preferably satisfies the relation represented by Expression (2c):

$$(G'_{Tm-10}(x)/G'_{Tm-20}(x))\leq 1.1 \quad \text{Expression (2c):}$$

Expressions (2b) and (2c) indicate that at different heating (storage) temperatures, the storage modulus at a low heating temperature is substantially identical to that at a high heating temperature. For this reason, a storage modulus satisfying the relation represented by Expression (2b), preferably Expression (2c) results in a small change in the crystal state of the crystalline material during storage of the toner at different temperatures including high temperature. As a result, the toner can have further improved heat-resistant storage characteristics, and can have a more stable low-temperature fixing characteristics of the toner and further reduced bleed-out of the crystalline material during long-term storage of the toner at different temperatures including high temperature.

(Measurement of Storage Modulus G')

A weighed toner sample (0.2 g) containing a particulate toner matrix and an external additive was molded under a pressure of 25 MPa with a compression molding machine to prepare a cylindrical pellet of the toner having a diameter of 10 mm.

A cooling operation was performed at a frequency of 1 Hz with a rheometer (made by TA Instruments-Waters LLC: ARES G2) using a set of an upper parallel plate having a diameter of 8 mm and a lower parallel plate having a diameter of 20 mm. The sample was placed between the plates at 100° C. The gap was set at 1.4 mm once, and the sample protruding from the gap between the plates was scraped. The gap was then set at 1.2 mm. While an axial force was being applied, the sample was cooled to any temperature, and was left to stand for three hours. The sample was cooled to a measurement starting temperature of 30° C., and the axial force was released. The storage modulus (G') was measured while the sample was heated from 30° C. to 150° C. at a heating rate of 3° C./min. The detailed conditions for measurement are listed:

Frequency: 1 Hz
Ramp rate: 3° C./min
Axicial force: 0 g, sensitivity: 10 g
Initial strain: 3.0%, Strain adjust: 30.0%, Minimum strain: 0.01%, Maximum strain: 10.0%
Minimum torque: 1 g·cm, Maximum torque: 80 g·cm
Sampling interval: 1.0° C./pt (Measurement of Melting Point ($T_m$) Derived from Crystalline Resin)

A toner sample (5 mg) containing an external additive is sealed in an aluminum pan KIT NO. B0143013. The aluminum pan is placed in a sample holder of a thermal analyzer Diamond DSC (made by PerkinElmer Inc.), and is heated. The peak temperature of the endothermic curve derived from the crystalline resin heated from 0° C. to 100° C. at a heating rate of 10° C./min in a first heating operation is defined as the melting point ($T_m$) derived from the crystalline resin.

In the observed endothermic peak, the peak of the mold release agent overlaps with that of the crystalline resin in some cases, and the peak of the mold release agent does not overlap with that of the crystalline resin in other cases. For this reason, the peak top is determined based on the three patterns (i-i), (i-ii), and (ii) illustrated in FIGS. 2A to 2C, respectively.

The overlap of the peak of the mold release agent with that of the crystalline resin indicates that the difference between the peak top temperatures is 3° C. or less (peak derived from the crystalline resin is unclear). Accordingly, these peaks do not overlap if the difference between the peak temperatures exceeds 3° C.

Figure 2A:
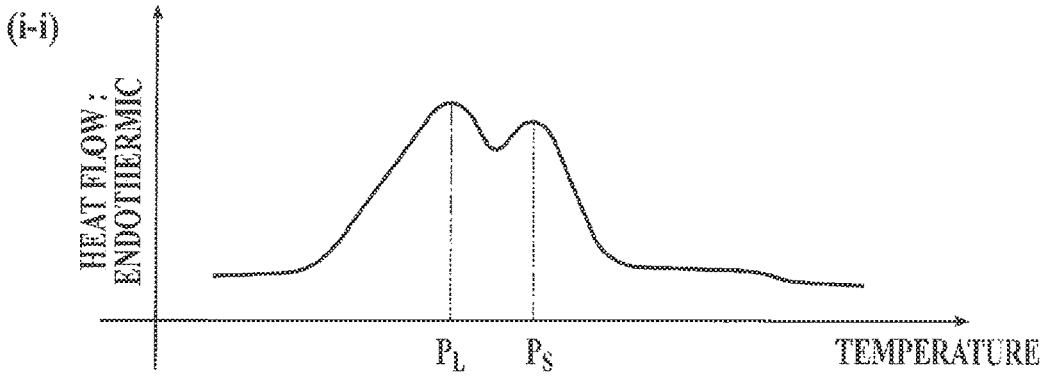
FIG. 2A is a schematic view illustrating one example DSC endothermic curve.
Figure 2B:
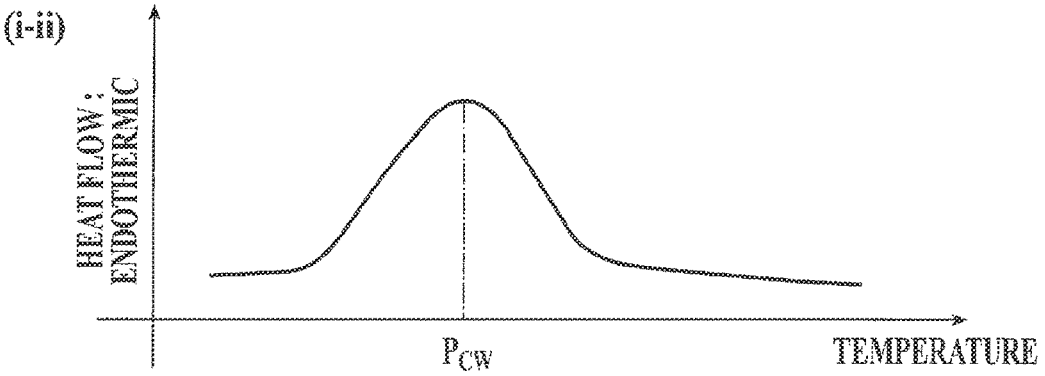
FIG. 2B is a schematic view illustrating another example DSC endothermic curve.
Figure 2C:
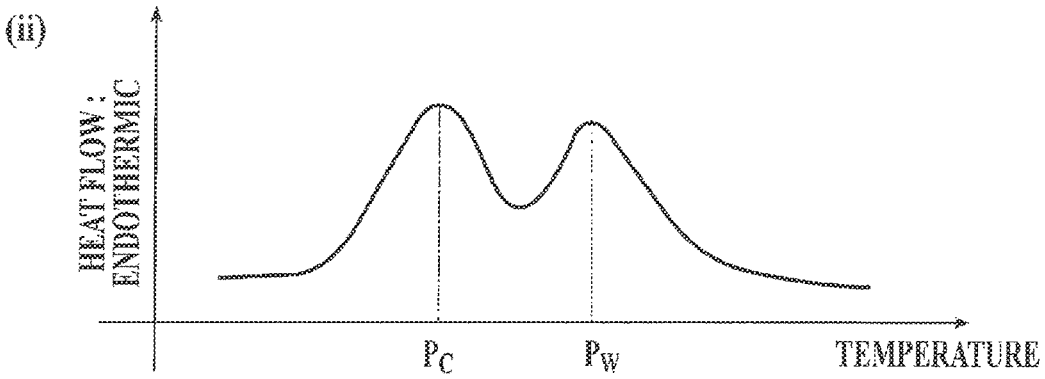
FIG. 2C is a schematic view illustrating another example DSC endothermic curve.

FIGS. 2A to 2C are schematic views illustrating DSC endothermic curves.

(i) Case of Peaks Overlapping (i-i) Case of Several Peak Tops

If several peaks overlap with each other and the several peak tops do not overlap with each other, the temperature of the peak top having a larger intensity is defined as the melting point ($T_m$) derived from the crystalline resin.

FIG. 2A illustrates a specific example in such a case. In the example of FIG. 2A, two peak tops are found, and the difference between their peak top temperatures $P_L$ and $P_S$ is 3° C. or less. In the example of FIG. 2A, the peak top temperature $P_L$ having a larger intensity is defined as the melting point ($T_m$) derived from the crystalline resin.

(i-ii) Case of Peak Tops Overlapping with Each Other

The peak top temperature is defined as the melting point ($T_m$) derived from the crystalline resin.

FIG. 2B illustrates a specific example in such a case. In the example of FIG. 2B, the endothermic peak of the crystalline resin overlaps with that of the mold release agent and their peak tops overlap with each other. In this case, the peak top temperature $P_{CW}$ is defined as the melting point ($T_m$) derived from the crystalline resin.

(ii) Case of Separate Peaks

In this case, the peak derived from the crystalline resin is evidently distinct. Accordingly, the peak top temperature derived from the crystalline resin is defined as the melting point ($T_m$) derived from the crystalline resin.

FIG. 2C illustrates a specific example in such a case. In the example illustrated in FIG. 2C, two peak tops are found, and the difference between their peak top temperatures $P_C$ and $P_W$ exceeds 3° C. In this case, it is believed that the endothermic peak derived from the crystalline resin does not overlap with that derived from the mold release agent, and the former can be distinguished from the latter. The peak temperature PC is defined as the melting point (Tm) derived from the crystalline resin.

The melting point ($T_m$° C.) derived from the crystalline resin is in the range of preferably 55 to 80° C., more preferably 60 to 75° C. A melting point within this range can further improve the low-temperature fixing characteristics and heat-resistant storage characteristics of the toner.

[Toner]

The electrostatic charge image developing toner according to the present invention (hereinafter, also simply referred to as "toner") comprises a particulate toner matrix containing a binder resin, and an external additive.

The particulate toner matrix according to the present invention may contain the binder resin, and a variety of internal additives, such as a colorant, a mold release agent, a charge controller, and a surfactant, when necessary.

In the present invention, the term "toner" refers to aggregation of "toner particles". The term "toner particle" refers to a particulate toner matrix including an external additive. In the description below, the term "toner particle" is also used unless the distinction between the particulate toner matrix and the toner particle is necessary.

[Binder Resin]

The binder resin according to the present invention comprises an amorphous polyester resin, a crystalline resin, and an amorphous vinyl resin. The crystalline resin can be another known resin that does not inhibit the advantageous effects of the present invention, such as a polyolefin resin or a polydiene resin.

The amorphous polyester resin and the amorphous vinyl resin are also collectively referred to "amorphous resin" unless their distinction is necessary.

In the present invention, the term "binder resin contains the crystalline resin" may indicate that the binder resin contains the crystalline resin itself, or may indicate that the binder resin contains the crystalline resin in the form of a segment contained in another resin, such as the crystalline polyester polymer segment in the hybrid crystalline resin described later. In the present invention, the term "binder resin contains the amorphous resin" may indicate that the binder resin contains the amorphous resin itself, such as the amorphous polyester resin and the amorphous vinyl resin, or may indicate that the binder resin contains the amorphous resin in the form of a segment contained in another resin, such as the amorphous resin segment in the hybrid crystalline resin described later.

(Crystalline Resin)

The crystalline resin indicates a resin having a clear endothermic peak rather than a stepwise endothermic change in DSC measurement of the toner. The clear endothermic peak has a half width of 15° C. or less in the DSC measurement of the toner at a heating rate of 10° C./min. The content of such a crystalline resin is preferably in the range of 5 to 20 mass % relative to the resins forming the particulate toner matrix (i.e., the binder resin and the mold release agent). Such a content of the crystalline resin can improve the sharp-melt characteristics of the binder resin to improve the low-temperature fixing characteristics of the toner, and can prevent a reduction in heat-resistant storage characteristics caused by the crystalline resin contained in the toner.

Examples of the crystalline resin include crystalline polyester resins, crystalline polyamide resins, crystalline polyurethane resins, crystalline polyacetal resins, crystalline polyethylene terephthalate resins, crystalline polybutylene terephthalate resins, crystalline polyphenylene sulfide resins, crystalline polyether ether ketone resins, and crystalline polytetrafluoroethylene resins.

Among these resins, preferred crystalline resins are crystalline polyester resins because the crystalline polyester resins are melted during thermal fixing to serve as a plasticizer for the amorphous resin, further improving the low-temperature fixing characteristics of the toner. The crystalline polyester resin can be prepared by a known process, such as a dehydration condensation reaction of polyvalent carboxylic acid with polyhydric alcohol. These crystalline polyester resins may be used alone or in combination.

The monomer forming the crystalline polyester resin contains preferably 50 mass % or more, more preferably 80 mass % or more of a linear aliphatic monomer. Use of a linear aliphatic monomer is preferred because use of an aromatic monomer often results in a crystalline polyester resin having a high melting point and use of a branched aliphatic monomer often results in a crystalline polyester resin having low crystallinity. A crystalline polyester resin containing 50 mass % or more of a linear aliphatic monomer can keep its crystallinity in the toner. A crystalline polyester resin containing 80 mass % or more of a linear aliphatic monomer can keep sufficient crystallinity.

Examples of the polyvalent carboxylic acid include saturated aliphatic dicarboxylic acids, such as succinic acid, sebacic acid, and dodecanedioic acid; alicyclic dicarboxylic acids, such as cyclohexane dicarboxylic acid; aromatic dicarboxylic acids, such as phthalic acid, isophthalic acid, and terephthalic acid; polyvalent carboxylic acids having three or higher valences, such as trimellitic acid and pyromellitic acid; acid anhydrides thereof; and alkyl esters thereof having 1 to 3 carbon atoms. Preferred polyvalent carboxylic acids are aliphatic dicarboxylic acids.

Examples of the polyhydric alcohol include aliphatic diols, such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and tri- or higher-hydric alcohols, such as glycerol, pentaerythritol, trimethylolpropane, and sorbitol. Preferred polyhydric alcohols are aliphatic diols.

The crystalline polyester resin preferably contains a hybrid crystalline polyester resin of at least a crystalline polyester polymer segment and a different polymer segment that are chemically bonded. In other words, the crystalline polyester resin preferably contains a hybrid crystalline polyester resin (hereinafter, also simply referred to as "hybrid crystalline resin") modified with a different resin (such as a styrene-acrylic resin, hereinafter, also referred to as "St-Ac resin"). For example, if the different resin is a styrene-acrylic resin, the styrene-acrylic resin moiety in the hybrid crystalline resin has high compatibility with the amorphous resin to enable homogeneous dispersions of the crystalline polyester resin in the particulate toner matrix. The hybrid crystalline polyester resin contained in the crystalline polyester resin can suitably control the compatibilization, incompatibilization, and crystallization of the binder resin and the mold release agent contained in the particulate toner matrix, more suitably achieving the advantageous effects of the present invention. Furthermore, if the particulate toner matrix has a core-shell structure described later and the shell contains a hybrid crystalline resin, the styrene-acrylic resin moieties in the crystalline polyester resin readily aggregate on the surfaces of the core particles containing the amorphous resin to facilitate coating of the entire surfaces of the core particles.

In this specification, the different resin indicates a resin different from polyester resin, and excludes resins having different monomer compositions and those of the same type having only a structural difference derived from modification, such as the styrene-acrylic modified polyester resin described later.

In the hybrid crystalline polyester resin, the resin moiety having a structure derived from the crystalline polyester resin is referred to as "crystalline polyester polymer segment", and the resin moiety having a structure derived from the different resin is referred to as "different polymer segment".

Examples of the different resin include vinyl resins, such as styrene-acrylic resins; urethane resins; and urea resins. These different polymer segments may be used alone or in combination.

The styrene-acrylic resin is a copolymer of a styrene monomer and a (meth)acrylate monomer.

Examples of the styrene monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives thereof. These styrene monomers may be used alone or in combination.

Examples of the (meth)acrylate monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl 6-hydroxyacrylate, propyl γ-aminoacrylate, stearyl methacrylate, dimethylaminoethyl methacrylate, diethylaminoethyl methacrylate, 2-hydroxyethyl (meth) acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono(meth)acrylate. These (meth)acrylate monomers may be used alone or in combination.

Other monomers can be used in addition to the styrene monomer and the (meth)acrylate monomer. Examples of usable other monomers include maleic acid, itaconic acid, cinnamic acid, fumaric acid, monoalkyl maleate ester, and monoalkyl itaconate ester.

The styrene-acrylic resin can be prepared as follows: One or more polymerization initiators, such as peroxides, persulfides, and azo compounds, usually used in polymerization are added to the monomers described above to polymerize the monomers by a known polymerization process, such as bulk polymerization, solution polymerization, emulsion polymerization, miniemulsion polymerization, suspension polymerization, or dispersion polymerization. A common chain transfer agent, such as alkylmercaptan or mercapto-fatty acid ester, can be used in polymerization to control the molecular weight.

A preferred content of the different polymer segment in the hybrid crystalline resin is 10 mass % or less in view of the low-temperature fixing characteristics of the toner.

A specific example of the process of preparing a hybrid crystalline polyester resin including a styrene-acrylic polymer segment as the different polymer segment (i.e., modified with the styrene-acrylic resin) will now be described.

In one exemplary process of preparing the hybrid crystalline resin, a crystalline polyester resin and a styrene-acrylic resin individually prepared are reacted to be chemically bonded. To facilitate the chemical bonding, a substituent reactive with both the crystalline polyester resin and the styrene-acrylic resin is preferably incorporated into the crystalline polyester resin or the styrene-acrylic resin. For example, during preparation of the styrene-acrylic resin, a compound having a substituent reactive with a carboxy group [COOH] or a hydroxy group [OH] in the crystalline polyester resin and a substituent reactive with the styrene-acrylic resin is added to the raw materials, i.e., the styrene monomer and the (meth)acrylate monomer. A styrene-acrylic resin having a substituent reactive with a carboxy or hydroxy group in the crystalline polyester resin can thereby be prepared.

In another example process, the hybrid crystalline resin is prepared through a polymerization reaction to generate a styrene-acrylic resin in the presence of a crystalline polyester resin preliminarily prepared or a polymerization reaction to generate a crystalline polyester resin in the presence of a styrene-acrylic resin preliminarily prepared. In both cases, a compound having a substituent reactive with both the crystalline polyester resin and the styrene-acrylic resin is added during the polymerization reaction. Specific examples of such a compound include acrylic acid, methacrylic acid, fumaric acid, maleic acid, and maleic anhydride.

The hybrid crystalline resin has a number average molecular weight (Mn) preferably in the range of 8500 to 12500, more preferably in the range of 9000 to 11000. A number average molecular weight (Mn) within this range is more preferred in view of the low-temperature fixing characteristics of the toner.

The preferred melting point ($T_m$° C.) of the crystalline resin is in the range of 55 to 80° C. because the toner can have higher low-temperature fixing characteristics and heat-resistant storage characteristics.

The melting point of the crystalline resin can be measured as in the measurement of the melting point ($T_m$° C.) derived from the crystalline resin except that the sample is the crystalline resin described above.

The content of the crystalline polyester resin in the binder resin is preferably 5 to 50 mass %. A content of the crystalline polyester resin of 5 mass % or more in the binder resin can achieve a sufficient low-temperature fixing effect of the toner. A content of 50 mass % or less can impart more suitable heat-resistant storage characteristics of the toner. The content of the crystalline resin in the particulate toner matrix is preferably 5 to 20 mass %, more preferably 7 to 15 mass %. A content of 5 mass % or more achieves a sufficient plasticizing effect, resulting in more suitable low-temperature fixing characteristics of the toner. A content of 20 mass % or less can further improve the heat-resistant storage characteristics of the toner and the stability of the toner against physical stress. A content in the range of 7 to 15 mass % facilitates control of the toner so as to have a preferred storage modulus through selection of the configuration of the amorphous resin or an appropriate process of preparing the particulate toner matrix.

The content of the crystalline resin in the total amount of the amorphous polyester resin and the crystalline resin is preferably more than 40 mass % and 60 mass % or less.

A content within this range facilitates blending of the amorphous polyester resin and the crystalline resin, achieving high low-temperature fixing characteristics of the toner. A content of the crystalline resin of more than 40 mass % can avoid complete blending of the crystalline resin with the amorphous resin, enabling more suitable crystallization of the crystalline resin by annealing and achieving favorable heat resistance of the toner. A content of 60 mass % or less results in sufficient blending of the crystalline resin, achieving favorable low-temperature fixing characteristics of the toner.

Preferably, the crystalline resin according to the present invention has a weight average molecular weight (Mw) in the range of 5000 to 50000 and a number average molecular weight in the range of 2000 to 10000 in view of low-temperature fixing characteristics and gloss stability of the toner.

The weight average molecular weight and the number average molecular weight in the present invention can be determined from the molecular weight distribution measured by gel permeation chromatography (GPC) as follows.

A sample is added to tetrahydrofuran such that the concentration of the sample is 1 mg/mL, and is dispersed at room temperature for five minutes with an ultrasonic dispersing machine. The solution is filtered through a membrane filter having a pore size of 0.2 μm to prepare a sample solution. While the column temperature is kept at 40° C., a carrier solvent tetrahydrofuran is fed through the columns at a flow rate of 0.2 mL/min using a gel permeation chromatograph HLC-8120GPC (made by Tosoh Corporation) and TSK guardcolumn+three columns of TSKgel SuperHZM-M (made by Tosoh Corporation). The sample solution (10 μL) is injected in the GPC apparatus together with the carrier solvent to measure the sample with a refractive index detector (RI detector). The molecular weight distribution of the sample is determined with a calibration curve that is created with ten standard particulate monodispersed polystyrenes.

(Amorphous Resin)

The particulate toner matrix according to the present invention contains amorphous resins containing an amorphous polyester or partially modified amorphous polyester resin (hybrid amorphous polyester resin) and an amorphous vinyl resin.

The amorphous resin is a noncrystalline resin exhibiting a glass transition temperature $T_g$ in an endothermic curve observed by differential scanning calorimetry and having no melting point, i.e., clear endothermic peak during the heating cycle.

The amorphous resin and the crystalline resin are used as binder resins to form the particulate toner matrix. The amorphous resin may comprise a urethane resin and a urea resin besides the amorphous polyester resin and the amorphous vinyl resin. The amorphous resin can be prepared by a known process, for example.

(Amorphous Vinyl Resin)

The amorphous vinyl resin can be any amorphous vinyl resin prepared through polymerization of a vinyl compound. Examples thereof include acrylate ester resins, styrene-acrylate ester resins, and ethylene-vinyl acetate resins. These resins may be used alone or in combination. Among these resins, preferred are styrene-acrylate ester resins (styrene-acrylic resins) in consideration of the plasticity during thermal fixing.

Preferably, the amorphous vinyl resin has a weight average molecular weight in the range of 20000 to 150000 and a number average molecular weight in the range of 5000 to 20000 in view of the compatibility between the fixing characteristics of the toner and the hot off-setting resistance thereof. The weight average molecular weight and the number average molecular weight can be determined as in the crystalline resin.

The amorphous vinyl resin preferably has a glass transition temperature ($T_g$) in the range of 20 to 70° C. in view of the compatibility between the fixing characteristics of the toner and the heat-resistant storage characteristics of the toner. The glass transition temperature can be measured according to a procedure specified in Standards of ASTM (American Society for Testing and Materials) D3418-82 (DSC method). The measurement can be performed with a DSC-7 differential scanning calorimeter (made by PerkinElmer Inc.) and a thermal analyzer controller TAC7/DX (made by PerkinElmer Inc.).

The amorphous vinyl resin may be a homopolymer of a single vinyl monomer or may be a copolymer of a vinyl monomer and a second monomer. The second monomer can be a styrene monomer, such as styrene or its derivative.

The content of the amorphous vinyl resin in the binder resin is preferably 50 mass % or more. If the amorphous vinyl resin is a main component in the binder resin (content of the amorphous vinyl resin in the binder resin is 50 mass % or more), the compatibilization or incompatibilization of the amorphous vinyl resin with the crystalline resin is readily controlled. In particular, the incompatibilization of the remaining resins for the binder resin and the amorphous vinyl resin is readily achieved because of their structural differences, and the crystallization of the crystalline resin can be saturated through annealing at lower temperature. For this reason, a binder resin containing 50 mass % or more of the amorphous vinyl resin is preferred because such a binder resin can suitably reduce a fluctuation in low-temperature fixing characteristics of the toner and the bleed-out of the crystalline material during long-term storage of the toner at high temperature.

(Amorphous Polyester Resin)

The amorphous polyester resin is a noncrystalline polyester resin among polyester resins prepared through a polycondensation reaction of a di- or higher-valent carboxylic acid (polyvalent carboxylic acid) with a di- or higher-valent alcohol (polyhydric alcohol). The amorphous polyester resin can also be used as a shell material in preparation of a toner having a core-shell structure.

The polyvalent carboxylic acids and polyhydric alcohols listed above as the materials for the crystalline polyester resin can be used as that for the amorphous polyester resin. Also usable are, for example, bisphenols, such as bisphenol A, bisphenol F, and alkylene oxide adducts, such as ethylene oxide and propylene oxide adducts, of bisphenols. Among these materials, preferred polyhydric alcohol components are ethylene oxide and propylene oxide adducts of bisphenol A to improve the charge uniformity of the toner in particular. These polyhydric alcohol components may be used alone or in combination.

The molar ratio [OH]/[COOH] of hydroxy groups in the polyhydric alcohol to carboxy groups in the polyvalent carboxylic acid is in the range of preferably 1.5/1 to 1/1.5, more preferably 1.2/1 to 1/1.2.

The amorphous polyester resin preferably has a number average molecular weight in the range of 2000 to 10000. The number average molecular weight can be determined as in the amorphous vinyl resin.

The amorphous polyester resin preferably has a glass transition temperature in the range of 20 to 70° C. The glass transition temperature can be determined as in the amorphous vinyl resin.

The amorphous polyester resin can be a hybrid amorphous polyester resin modified with a styrene-acrylic resin (hereinafter, also simply referred to as "hybrid amorphous resin") as in the crystalline polyester resin described above.

The styrene-acrylic resin moieties of the hybrid amorphous resin have high compatibility with the amorphous vinyl resin, enabling homogeneous dispersion of the amorphous polyester resin in the particulate toner matrix. If the particulate toner matrix has a core-shell structure and the shell contains the amorphous polyester resin, the hybrid amorphous resin readily aggregate on the surfaces of the core particles containing amorphous vinyl resin to facilitate coating of the entire surfaces of the core particles.

In the present invention, the term "amorphous polyester resin is modified with the styrene-acrylic resin" indicates that an amorphous polyester polymer segment is chemically bonded to a styrene-acrylic polymer segment. The amorphous polyester polymer segment indicates a resin moiety derived from an amorphous polyester resin in a hybrid resin, i.e., a chain having the same chemical structure as that of the amorphous polyester resin. The styrene-acrylic polymer segment indicates a resin moiety derived from a styrene-acrylic resin in the hybrid resin, i.e., a chain having the same chemical structure as that of the styrene-acrylic resin. The styrene-acrylic resin can be prepared with the same materials as those for the hybrid crystalline resin.

The hybrid amorphous polyester resin more preferably has a number average molecular weight in the range of 2000 to 10000 in view of the fixing characteristics of the toner.

The content of the amorphous polyester resin in the particulate toner matrix is preferably in the range of 1 to 50 mass % in view of the fixing characteristics of the toner and the environmental stability of charge.

[Colorant]

Any known inorganic or organic colorant for color toner can be used.

Examples of the colorant include carbon black, magnetic substances, pigments, and dyes. These colorants can be used alone or in combination.

Examples of the carbon black include channel black, furnace black, acetylene black, thermal black, and lamp black. Examples of the magnetic substances include ferromagnetic metals, such as iron, nickel, and cobalt; alloys containing these metals; and compounds of ferromagnetic metals, such as ferrite and magnetite.

Examples of the pigments include C.I. Pigment Reds 2, 3, 5, 7, 15, 16, 48:1, 48:3, 53:1, 57:1, 81:4, 122, 123, 139, 144, 149, 166, 177, 178, 208, 209, 222, 238, and 269, C.I. Pigment Oranges 31 and 43, C.I. Pigment Yellows 3, 9, 14, 17, 35, 36, 65, 74, 83, 93, 94, 98, 110, 111, 138, 139, 153, 155, 180, 181, and 185, C.I. Pigment Green 7, C.I. Pigment Blues 15:3, 15:4, and 60, and phthalocyanine pigments containing a central metal, such as zinc, titanium, or magnesium.

Examples of the dyes include C.I. Solvent Reds 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176, and 179, pyrazolotriazole azo dyes, pyrazolotriazole azomethine dyes, pyrazolone azo dyes, pyrazolone azomethine dyes, C.I. Solvent Yellows 19, 44, 77, 79, 81, 82, 93, 98, 103, 104, 112, and 162, and C.I. Solvent Blues 25, 36, 60, 70, 93, and 95.

[Mold Release Agent]

Examples of the mold release agent (wax) include hydrocarbon waxes and ester waxes. Examples of the hydrocarbon waxes include low molecular weight polyethylene waxes, low molecular weight polypropylene waxes, Fischer-Tropsch waxes, microcrystalline waxes, and paraffin waxes. Examples of the ester waxes include carnauba waxes, pentaerythritol behenate ester, behenyl behenate, and behenyl citrate. These mold release agents may be used alone or in combination.

[Charge Controller]

Examples of the charge controller include nigrosine dyes, metal salts of naphthenic or higher fatty acids, alkoxylated amines, quaternary ammonium salts, azo metal complexes, and metal salts of salicylic acid or metal complexes thereof. These charge controllers may be used alone or in combination.

[Surfactant]

Examples of the surfactant include anionic surfactants, such as salts of sulfates, sulfonates, and phosphates; cationic surfactants, such as amine salts and quaternary ammonium salts; and nonionic surfactants, such as polyethylene glycol, alkyl phenol ethylene oxide adducts, and polyhydric alcohols. The surfactants may be used alone or in combination.

Specific examples of the anionic surfactants include sodium dodecylbenzenesulfonate, sodium dodecylsulfate, sodium alkylnaphthalenesulfonate, and sodium dialkylsulfosuccinate. Specific examples of the cationic surfactants include alkylbenzenedimethylammonium chloride, alkyltrimethylammonium chloride, and distearylammonium chloride. Examples of the nonionic surfactants include polyoxyethylene alkyl ether, glycerol fatty acid ester, sorbitan fatty acid ester, polyoxyethylene sorbitan fatty acid ester, and polyoxyethylene fatty acid ester.

[Structure of Particulate Toner Matrix]

Although the particulate toner matrix according to the present invention may have a single layer structure of only the particulate toner matrix, the particulate toner matrix preferably has a core-shell structure. A core-shell structure of the particulate toner matrix can further improve the low-temperature fixing characteristics and heat-resistant storage characteristics of the toner.

The particulate toner matrix having a core-shell structure indicates a particulate toner matrix having a multi-layer structure including the particulate toner matrix as a core particle and a shell coating the surface of the core particle. The entire surface of the core particle may or may not be coated with shell, that is to say, a part of the core particle may be exposed. The cross-section of the core-shell structure can be verified with any known analytical instrument, for example, a transmission electron microscope (TEM) or a scanning probe microscope (SPM).

In the core-shell structure, the core particle and the shell can have different characteristics, such as glass transition temperature, melting point, and hardness, to design a desired toner particle. For example, a resin having a relatively high glass transition temperature can be aggregated, and be fused onto the surface of a core particle containing a binder resin, a colorant, and a mold release agent and having a relatively low glass transition temperature to form a shell. The shell can be formed with the amorphous polyester resin described above. Among these amorphous polyester resins, preferred are amorphous polyester resins modified with the styrene-acrylic resin.

[Diameter of Toner Particles]

The toner particles have a volume median diameter in the range of preferably 3 to 8 μm, more preferably 5 to 8 μm.

In the present invention, it is assumed that the diameter of the toner particles is equal to the particle diameter of the particulate toner matrix.

The volume median particle diameter can be measured with a Multisizer 3 analyzer (made by Beckman Coulter, Inc.) connected to a computer system including Software V3.51 for data processing. Specifically, a sample toner (0.02 g) is mixed with 20 mL of a surfactant solution (surfactant solution for dispersing toner particles, which is prepared with a neutral detergent containing a surfactant component, and is diluted ten fold with pure water), and is ultrasonically dispersed for one minute to prepare a toner dispersion. The toner dispersion is injected with a pipette into ISOTON II (made by Beckman Coulter, Inc.) in a beaker on a sample stand until the analyzer displays a concentration of 8%. This concentration of the dispersion can provide reproducibility in the measurement.

The counts of the particles to be measured are set at 25000 and the aperture diameter 100 μm in the analyzer. The range of the measurement from 2 to 60 μm is divided into 256 subranges to calculate the frequencies in the subranges. The 50% particle diameter from the maximum-volume fraction in the cumulative distribution curve is defined as a volume median particle diameter.

[Average Circularity of Toner Particles]

The toner particles according to the present invention have an average circularity in the range of preferably 0.930 to 1.000, more preferably 0.950 to 0.995. An average circularity within this range can reduce the crush of the toner particles to reduce contamination of a frictional charger, stabilizing the charging characteristics of the toner. Such a toner can form high-quality images.

The average circularity can be measured as follows. A toner dispersion is prepared as in the measurement of the median particle diameter of the toner. The toner dispersion is photographed with FPIA-2100 or FPIA-3000 (both made by Sysmex Corporation) in a high power field (HPF) mode at an appropriate density (the number of particles to be detected at an HPF: 3000 to 10000 particles) to calculate the circularities of the toner particles from Expression (y). The circularities of the toner particles are added, and the sum is divided by the number of toner particles to calculate the average circularity. The number of particles to be detected at an HPF within this range can provide sufficient reproducibility. In Expression (y), L1 represents the perimeter (μm) of a circle having an area identical to that of the projected image of a particle; and L2 represents the perimeter (μm) of the projected image of the particle.

$$\text{Circularity}=L1/L2 \qquad \text{Expression (y):}$$

[External Additive]

One or more external additives may be used in the present invention. Any known external additive can be used. Examples thereof include particles of silica, titania, alumina, zirconia, zinc oxide, chromium oxide, cerium oxide, antimony oxide, tungsten oxide, tin oxide, tellurium oxide, manganese oxide, and boron oxide.

The external additive more preferably contains silica particles prepared by a sol-gel process. The silica particles prepared by the sol-gel process, which has a narrow particle diameter distribution, preferably reduce variation of the adhesive strength of the external additive to the particulate toner matrix.

Silica primary particles preferably have a number average diameter in the range of 70 to 200 nm. The number average diameter of the silica primary particles within this range is larger than those of primary particles of other external additives. Such silica particles accordingly serve as a spacer in a two-component developer. Silica particles preferably prevent other external additives having smaller particle sizes from being buried in the particulate toner matrix during agitation of the two-component developer in the developing apparatus. The silica particles also preferably prevent fusion of particulate toner matrices.

The number average diameter of the primary particles of the external additive can be determined through analysis of an image taken with a transmission electron microscope, for example, and can be controlled through classification of the primary particles or mixing of classified primary particles with different diameters.

The external additive preferably has a hydrophobic surface. Hydrophobic treatment is performed with a known surface treating agent. One or more surface treating agents can be used. Examples thereof include silane coupling agents, silicone oils, titanate coupling agents, aluminate coupling agents, fatty acids, fatty acid metal salts and esterified products thereof, and rosin acid.

Examples of the silane coupling agents include dimethyldimethoxysilane, hexamethyldisilazane (HMDS), methyltrimethoxysilane, isobutyltrimethoxysilane, and decyltrimethoxysilane. Examples of the silicone oil include cyclic compounds and linear or branched organosiloxanes, specifically, organosiloxane oligomers, octamethylcyclotetrasiloxane, decamethylcyclopentasiloxane, tetramethylcyclotetrasiloxane, and tetravinyltetramethylcyclotetrasiloxane.

Examples of the silicone oil also include highly reactive silicone oils having at least one terminal modified with a functional group introduced into at least one of terminals in a side chain and the main chain. One or more functional groups can be used. Examples thereof include alkoxy, carboxy, carbinol, higher fatty acid-modified, phenol, epoxy, methacrylic, and amino groups.

The content of the external additive is preferably in the range of 0.1 to 10.0 mass % relative to the total amount of the toner particles. The content is more preferably in the range of 1.0 to 3.0 mass %.

[Developer]

A toner for a one-component developer is composed of only the toner particles, and a toner for a two-component developer is composed of the toner particles and carrier particles. The content of the toner particles (toner concentration) in the two-component developer is usually in the range of 4.0 to 8.0 mass %, for example.

The carrier particles are composed of a magnetic substance. Examples of the carrier particles include resin-coated carrier particles composed of core material particles of a magnetic substance coated with a layer of a coating material, and resin-dispersed carrier particles having magnetic substance powder dispersed in a resin. Preferred carrier particles are the resin-coated carrier particles to reduce the adhesion of the carrier particles onto a photoreceptor.

The core material particles are composed of the magnetic substance, such as a substance strongly magnetized in the direction of a magnetic field. One or more magnetic substances can be used. Examples thereof include ferromagnetic metals, such as iron, nickel, and cobalt; alloys containing these metals; compounds of ferromagnetic metals; alloys containing no ferromagnetic metal but demonstrating ferromagnetism through a heat treatment; and metal oxide.

Examples of the ferromagnetic metals or the compounds containing the ferromagnetic metals include iron, ferrite represented by Formula (a), and magnetite represented by Formula (b). In Formulae (a) and (b), M represents a mono- or divalent metal selected from the group consisting of Mn, Fe, Ni, Co, Cu, Mg, Zn, Cd, and Li.

$$MO.Fe_2O_3 \qquad \text{Formula (a):}$$

$$MFe_2O_4 \qquad \text{Formula (b):}$$

Examples of alloys demonstrating ferromagnetism through a heat treatment include Heusler alloys, such as manganese-copper-aluminum and manganese-copper-tin. Example of metal oxide includes chromium dioxide.

The core material particles are preferably ferrite. This is because the resin-coated carrier particles have a true density smaller than that of a metal forming the core material particles, resulting in reduced stirring impact during stirring of the toner in a developing apparatus.

One or more coating materials may be used. A known coating material for coating the core material particles of the carrier particles can be used. A preferred coating material is a resin having a cycloalkyl group because the resulting carrier particles have reduced moisture adsorption and higher adhesion between the coating layer and the core material particles. Examples of the cycloalkyl group include cyclohexyl, cyclopentyl, cyclopropyl, cyclobutyl, cycloheptyl, cyclooctyl, cyclononyl, and cyclodecyl groups. Among these groups, preferred is a cyclohexyl or cyclopentyl group, and more preferred is a cyclohexyl group in view of the adhesion between the coating layer and the ferrite particles.

The resin having a cycloalkyl group has a weight average molecular weight in the range of, for example, 10000 to 800000, more preferably 100000 to 750000. The content of the cycloalkyl group in the resin is in the range of 10 to 90 mass %, for example. The content of the cycloalkyl group in the resin can be determined by known instrumental analysis, for example, P-GC/MS or $^1$H-NMR.

The two-component developer can be prepared through mixing of the toner particles with the carrier particles in an appropriate proportion in a mixer. Examples of the mixer include nauta mixer, double cone mixer, and V-type mixer.

The size and shape of the toner particles can be appropriately determined in the range imparting the advantageous effects of the present embodiment. For example, the volume average diameter of the toner particles is in the range of 3.0 to 8.0 μm, and the average circularity is in the range of 0.920 to 1.000.

The size and shape of the carrier particles can be appropriately determined in the range imparting the advantageous effects of the present embodiment. For example, the volume average diameter of the carrier particles is in the range of 15 to 100 μm. The volume average diameter of the carrier particles can be determined by a wet process with a laser diffraction sensor "HELOS KA" (made by Sympatec GmbH). The volume average diameter of the carrier particles can be controlled through variation of conditions for preparation of the core material particles to control the diameters of the core material particles, classification of the carrier particles, or mixing of classified carrier particles of different diameters, for example.

[Preparation of Toner]

The toner according to the present invention can be prepared by any known process; in particular, emulsion polymerization aggregation or emulsion aggregation can be suitably used.

Emulsion aggregation is preferred in preparation of the toner according to the present invention. In this process, the toner particles are prepared as follows: A poor solvent is added dropwise to the binder resin solution to perform phase transition emulsification, and the solvent is removed to prepare a dispersion of binder resin nanoparticles. The dispersion of binder resin nanoparticles is mixed with a colorant dispersion and a dispersion of a mold release agent, such as wax, to aggregate the binder resin nanoparticles so that toner particles have a desired diameter. The binder resin nanoparticles are further fused to control the shapes of the toner particles.

One exemplary preparation process of the toner according to the present invention by emulsion aggregation involves:

(1) a step of dispersing colorant nanoparticles in an aqueous medium to prepare a dispersion of colorant nanoparticles, (2) a step of dispersing binder resin nanoparticles in an aqueous medium to prepare a dispersion of binder resin nanoparticles, the binder resin nanoparticles containing an internal additive when necessary, (3) a step of mixing the dispersion of colorant nanoparticles with the dispersion of binder resin nanoparticles to aggregate, associate, and fuse the colorant nanoparticles and the binder resin nanoparticles to form particulate toner matrices, (4) a step of filtering the particulate toner matrices from the dispersion system (aqueous medium) of the particulate toner matrices to remove the surfactant, (5) a step of drying the particulate toner matrices, and (6) a step of adding an external additive to the particulate toner matrices.

In the preparation of the toner according to the present invention, the step (3) preferably involves a heat treating (annealing) step. A toner satisfying the relations represented by Expressions (1a), (1b), and (2a) in the present invention can be suitably prepared through annealing performed in the step of preparing the toner, and can suitably have favorable low-temperature fixing characteristics and heat-resistant storage characteristics during storage of the toner under actual use conditions for the toner at different temperatures including high temperatures.

One specific example of the step (3) will now be described.

A dispersion of binder resin nanoparticles of a crystalline polyester resin, an amorphous polyester resin, and an amorphous vinyl resin and a dispersion of colorant nanoparticles are placed in a reactor equipped with a stirrer, a temperature sensor, and a cooling tube. A solution of an aggregating agent (such as magnesium chloride) is added under stirring, and the binder resin nanoparticles and the colorant nanoparticles are aggregated, associated, and fused to be grown into toner particles. An aqueous solution of sodium chloride is added at a desired timing to terminate the growth of the toner particles. In the next step, the solution is heated to fuse the toner particles with stirring until the average circularity of the toner particles reaches a desired value. The solution is cooled.

A heat treating (annealing) step is then performed; for example, the solution is heated to 50° C. over 30 minutes, and is kept at the temperature for about three hours. The solution is then cooled to 30° C. or less. The steps (4) to (6) are then performed to prepare the toner according to the present invention.

If the step (3) involves annealing, the toner according to the present invention satisfying the relations represented by Expressions (1a), (1b), and (2a) can be suitably prepared.

The steps (1), (2), and (4) to (6) excluding the step (3) can be suitably performed by any known process. Any other known steps rather than the steps (1) to (6) can be used in the range not inhibiting the advantageous effects of the present invention.

The above-mentioned embodiments should not be construed to limit the present invention and may be appropriately modified within the scope of the present invention.

EXAMPLES

The present invention will now be described in detail by way of non-limiting Examples. In Examples, "parts" and "%" are on the mass basis, unless otherwise specified.

[Synthesis of Crystalline Polyester Resin 1]

The following raw material monomers (including bi-reactive monomers) for an addition polymerization resin composed of a different polymer segment (styrene-acrylic polymer segment, also referred to as "St-Ac polymer segment") and a radical polymerization initiator were placed into a dropping funnel.

| | |
|---|---|
| Styrene | 43.5 parts by mass |
| n-Butyl acrylate | 16.0 parts by mass |
| Acrylic acid | 3.5 parts by mass |
| Polymerization initiator (di-t-butyl peroxide) | 8.0 parts by mass |

The following raw material monomers for a crystalline polyester (CPEs) polymer segment (polycondensed segment) were placed into a four-necked flask equipped with a nitrogen inlet tube, a dehydration tube, a stirrer, and a thermocouple, and were heated to 170° C. to be dissolved.

| | |
|---|---|
| Tetradecanedioic acid | 440.0 parts by mass |
| Butanediol | 135.0 parts by mass |

In the next stage, the raw material monomers for an addition polymer segment (St-Ac polymer segment) were added dropwise over 90 minutes under stirring, and were aged for 60 minutes. The unreacted monomers were then removed under reduced pressure (8 kPa). The amount of the removed monomers was significantly small relative to the total amount of the raw material monomers for an addition polymerization resin.

An esterification catalyst $Ti(OBu)_4$ (0.8 parts by mass) was then added, and the reaction system was heated to 235° C. The reaction was performed under normal pressure (101.3 kPa) for five hours and further under reduced pressure (8 kPa) for one hour.

After the system is cooled to 200° C., the reaction was performed under reduced pressure (20 kPa) for one hour to yield Crystalline polyester resin 1. Crystalline polyester resin 1 contained 10 mass % different polymer segment (St-Ac polymer segment) relative to the total amount of Crystalline polyester resin 1, and the CPEs polymer segments were grafted to the St-Ac polymer segment. Crystalline polyester resin 1 had a number average molecular weight (Mn) of 9500 and a melting point ($T_m$) of 72° C.

[Synthesis of Crystalline Polyester Resin 2]

Crystalline polyester resin 2 was prepared as in the synthesis of Crystalline polyester resin 1 except that a polycondensed segment, i.e., a crystalline polyester polymer segment (CPEs polymer segment) was prepared with the following raw monomers: tetradecanoic acid (440.0 parts by mass) and 1,6-hexanediol (173.0 parts by mass).

Crystalline polyester resin 2 had a number average molecular weight (Mn) of 8500 and a melting point ($T_m$) of 75° C.

[Synthesis of Crystalline Polyester Resin 3]

Crystalline polyester resin 3 was prepared as in the synthesis of Crystalline polyester resin 1 except that a polycondensed polymer segment, i.e., a crystalline polyester polymer segment (CPEs polymer segment) was prepared with the following raw monomers: sebacic acid (343.0 parts by mass) and 1,6-hexanediol (173.0 parts by mass).

Crystalline polyester resin 3 had a number average molecular weight (Mn) of 8000 and a melting point ($T_m$) of 60° C.

[Synthesis of Crystalline Polyester Resin 4]

Crystalline polyester resin 4 was prepared as in the synthesis of Crystalline polyester resin 1 except that a polycondensed segment, i.e., a crystalline polyester polymer segment (CPEs polymer segment) was prepared with the following raw monomers: dodecanedioic acid (391.0 parts by mass) and 1,9-nonanediol (240.0 parts by mass).

Crystalline polyester resin 4 had a number average molecular weight (Mn) of 9000 and a melting point ($T_m$) of 66° C.

[Synthesis of Crystalline Polyester Resin 5]

Crystalline polyester resin 5 was prepared as in the synthesis of Crystalline polyester resin 3 except that an addition polymer segment, i.e., a styrene-acrylic polymer segment (St-Ac polymer segment) was prepared with the following raw monomers: styrene (87.0 parts by mass), n-butyl acrylate (32.0 parts by mass), acrylic acid (7.0 parts by mass), and a polymerization initiator (di-t-butyl peroxide) (16.0 parts by mass).

Crystalline polyester resin 5 had a number average molecular weight (Mn) of 11000 and a melting point ($T_m$) of 58° C.

[Synthesis of Crystalline Polyester Resin 6]

Crystalline polyester resin 6 was prepared as in the synthesis of Crystalline polyester resin 1 except that a polycondensed segment, i.e., a crystalline polyester polymer segment (CPEs polymer segment) was prepared with the following raw monomers: dodecanedioic acid (391.0 parts by mass) and ethylene glycol (100.0 parts by mass).

Crystalline polyester resin 6 had a number average molecular weight (Mn) of 10000 and a melting point ($T_m$) of 80° C.

[Preparation of Dispersion 1 of Crystalline Polyester Resin Particles]

Crystalline polyester resin 1 (82 parts by mass) was dissolved in methyl ethyl ketone (82 parts by mass) with stirring at 70° C. for 30 minutes. In the next stage, an aqueous solution (2.5 parts by mass) of 25 mass % sodium hydroxide (degree of neutralization: about 50%) was added to the solution. The solution was placed into a reactor with a stirrer. While the solution was being stirred, water (236 parts by mass) heated to 70° C. was added dropwise to the solution over 70 minutes. The solution in the reactor became cloudy halfway the addition of water. After the addition of the entire amount of water, a homogeneous emulsion was yielded. The diameters of oil droplets in the emulsion were measured with a laser diffraction particle size distribution analyzer "LA-750 (made by HORIBA Ltd.)". The oil droplets had a volume average diameter of 123 nm.

In the next stage, while being kept at 70° C., the emulsion was stirred with a diaphragm vacuum pump "V-700" (made by BUCHI Labortechnik AG) for three hours under a reduced pressure of 15 kPa (150 mbar) to distill off methyl ethyl ketone. "Dispersion 1 of crystalline polyester resin particles" containing dispersed nanoparticles of Crystalline polyester resin 1 (solid content: 25 mass %) was thereby prepared. The crystalline polyester resin nanoparticles in the dispersion had a volume average diameter of 75 nm determined with the particle size distribution analyzer.

[Preparation of Dispersions 2 to 6 of Crystalline Polyester Resin Particles]

Dispersions 2 to 6 of crystalline polyester resin particles were prepared as in preparation of Dispersion 1 of crystalline polyester resin particles except that Crystalline polyester resin 1 was replaced with Crystalline polyester resins 2 to 6.

The crystalline polyester resin nanoparticles in the dispersion had a volume average diameter of 200 nm.

(Preparation of Colorant Particle Dispersion)

Sodium dodecylsulfate (90 parts by mass) was added to deionized water (1600 parts by mass). While the solution was being stirred, copper phthalocyanine (C.I. Pigment Blue 15:3) (420 parts by mass) was gradually added. Copper phthalocyanine was dispersed with a stirrer "Cleamix" (registered trademark, made by M Technique Co., Ltd.) to prepare a colorant particle dispersion. The colorant particles in the dispersion had a volume median diameter of 110 nm.

(Preparation of Dispersion 1 of Mold Release Agent Particles)

| | |
|---|---|
| Behenyl behenate (mold release agent, melting point: 73° C.) | 100.0 parts by mass |
| Anionic surfactant (made by Dai-ichi Kogyo Seiyaku Co., Ltd., NEOGEN RK) | 10.0 parts by mass |
| Deionized water | 400.0 parts by mass |

These materials were mixed, were heated to 80° C., and were sufficiently dispersed with an ULTRA-TURRAX T50 mixer made by IKA-Werke GmbH & Co. KG These materials were then dispersed with a pressurizing ejection Gaulin homogenizer. Deionized water was added to the dispersion to adjust the solid content to 15 mass %. Dispersion 1 of mold release agent particles was thereby prepared. The size of the mold release agent particles in the dispersion was measured with a laser diffraction particle size distribution analyzer LA-750 (made by HORIBA, Ltd.). The mold release agent particles in the dispersion had a volume median diameter of 220 nm.

(Preparation of Amorphous Polyester Resin)

A mixed solution of a vinyl resin monomer, the monomers having a substituent reactive with both the amorphous polyester resin and the vinyl resin, and a polymerization initiator listed below was placed into a dropping funnel.

| | |
|---|---|
| Styrene | 80.0 parts by mass |
| n-Butyl acrylate | 20.0 parts by mass |
| Acrylic acid | 10.0 parts by mass |
| di-t-Butyl peroxide (polymerization initiator) | 16.0 parts by mass |

The following raw monomers for the amorphous polyester resin were placed into a four-necked flask equipped with a nitrogen inlet tube, a dehydration tube, a stirrer, and a thermocouple, and was dissolved with heating to 170° C.

| | |
|---|---|
| Bisphenol A ethylene oxide 2 mol adduct | 59.1 parts by mass |
| Bisphenol A propylene oxide 2 mol adduct | 281.7 parts by mass |
| Terephthalic acid | 63.9 parts by mass |
| Succinic acid | 48.4 parts by mass |

The mixed solution in the dropping funnel was added dropwise to the four-necked flask over 90 minutes under stirring, and was aged for 60 minutes. The unreacted monomers were then removed under reduced pressure (8 kPa). An esterification catalyst $Ti(OBu)_4$ (0.4 parts by mass) was then placed into the four-necked flask. The system was heated to 235° C. to perform a reaction under normal pressure (101.3 kPa) for five hours, and further under reduced pressure (8 kPa) for one hour.

The system was then cooled to 200° C. The reaction was performed under reduced pressure (20 kPa), and then the solvent was removed to yield an amorphous polyester resin. The amorphous polyester resin had a weight average molecular weight (Mw) of 24000, an acid value of 16.2 mgKOH/g, and a glass transition temperature ($T_g$) of 60° C.

(Preparation of Dispersion of Amorphous Polyester Resin Particles)

In the next step, the amorphous polyester resin (100 parts by mass) was dissolved in ethyl acetate (made by KANTO CHEMICAL CO., INC.) (400 parts by mass), and was mixed with a solution (638 parts by mass) of 0.26 mass % sodium laurylsulfate preliminarily prepared. While being stirred, the mixed solution was dispersed with an ultrasonic homogenizer US-150T (made by NIHONSEIKI KAISHA LTD.) at a V-LEVEL of 400 IA for 30 minutes. The mixed solution was then heated to 40° C. In this state, ethyl acetate was completely removed with a diaphragm vacuum pump V-700 (made by BUCHI Labortechnik AG) while the mixed solution was being stirred under reduced pressure for three hours. A dispersion of amorphous polyester resin particles (solid content: 13.5 mass %) was prepared. The amorphous polyester resin particles in the dispersion had a volume median diameter of 98 nm.

[Preparation of Vinyl Resin Particle Dispersion 1]

(First Polymerization)

Sodium dodecylsulfate (8 parts by mass) and deionized water (3000 parts by mass) were placed into a 5 L reactor equipped with a stirrer, a temperature sensor, a cooling tube, and a nitrogen inlet. While these materials were being stirred under a nitrogen stream at a stirring rate of 230 rpm, the inner temperature was controlled to 80° C. After heating, a solution of potassium persulfate (10 parts by mass) in deionized water (200 parts by mass) was added. The solution temperature was again controlled to 80° C., and a mixed solution of the following monomers was added dropwise over one hour.

| | |
|---|---|
| Styrene | 480.0 parts by mass |
| n-Butyl acrylate | 250.0 parts by mass |
| Methacrylic acid | 68.0 parts by mass |

After addition of the mixed solution, the monomers were polymerized with heating at 80° C. for two hours under stirring to prepare a vinyl resin particle dispersion.

(Second Polymerization)

Deionized water (1100 parts by mass) and the vinyl resin particle dispersion (solid content: 55 parts by mass) prepared in the first polymerization stage were placed into a 5 L reactor equipped with a stirrer, a temperature sensor, a cooling tube, and a nitrogen inlet, and were heated to 87° C. A mixed solution of the following monomers, a chain transfer agent, and a mold release agent dissolved at 80° C. was dispersed with a mechanical dispersing machine Cleamix having a circulation path (made by M Technique Co., Ltd.) for ten minutes to prepare a dispersion containing emulsified particles (oil droplets). The dispersion was added to the 5 L reactor, and a polymerization initiator solution of potassium persulfate (5.5 parts by mass) in deionized water (100 parts by mass) was added. The system was heated with stirring at 87° C. over one hour to perform polymerization. A vinyl resin particle dispersion was thereby prepared.

| | |
|---|---|
| Styrene | 256.0 parts by mass |
| 2-Ethylhexyl acrylate | 95.0 parts by mass |
| Methacrylic acid | 30.0 parts by mass |
| n-Octyl 3-mercaptopropionate (chain transfer agent) | 3.9 parts by mass |
| Behenyl behenate (mold release agent, melting point: 73° C.) | 136.8 parts by mass |
| Microcrystalline wax (mold release agent, melting point: 80° C.) | 7.2 parts by mass |

(Third Polymerization)

A solution of potassium persulfate (8 parts by mass) in deionized water (140 parts by mass) was further added to the vinyl resin particle dispersion prepared through the second polymerization. A mixed solution of the monomers and the chain transfer agent listed below were added dropwise at 84° C. over 90 minutes:

| | |
|---|---|
| Styrene (St) | 367.2 parts by mass |
| n-Butyl acrylate (BA) | 165.0 parts by mass |
| Methacrylic acid (MAA) | 34.3 parts by mass |
| Methyl methacrylate (MMA) | 52.5 parts by mass |
| n-Octyl 3-mercaptopropionate | 8.0 parts by mass |

After the addition, the mixed solution was heated with stirring over two hours to be polymerized, and was cooled to 28° C. to prepare Vinyl resin particle dispersion 1.

[Preparation of Vinyl Resin Particle Dispersion 2]

Vinyl resin particle dispersion 2 was prepared as in preparation of Vinyl resin particle dispersion 1 except that the monomers, the chain transfer agent, and the mold release agent dissolved in the second polymerization stage were varied as follows:

(Second Polymerization)

| | |
|---|---|
| Styrene | 256.0 parts by mass |
| 2-Ethylhexyl acrylate | 47.5 parts by mass |
| n-Butyl acrylate | 47.5 parts by mass |
| Methacrylic acid | 30.0 parts by mass |
| n-Octyl 3-mercaptopropionate (chain transfer agent) | 3.9 parts by mass |
| Behenyl behenate (mold release agent, melting point: 73° C.) | 136.8 parts by mass |
| Microcrystalline (mold release agent, melting point: 80° C.) | 7.2 parts by mass |

[Preparation of Vinyl Resin Particle Dispersion 3]

Vinyl resin particle dispersion 3 was prepared as in preparation of Vinyl resin particle dispersion 1 except that the monomers, the chain transfer agent, and the mold release agent dissolved in the second polymerization stage and the monomers and the chain transfer agent in the mixed solution added in the third polymerization stage were varied as follows.

(Second Polymerization)

| | |
|---|---|
| Styrene (St) | 256.0 parts by mass |
| 2-Ethylhexyl acrylate (2-EHA) | 95.0 parts by mass |
| Methacrylic acid (MAA) | 30.0 parts by mass |
| n-Octyl 3-mercaptopropionate (chain transfer agent) | 3.9 parts by mass |
| Behenyl behenate (mold release agent, melting point: 73° C.) | 136.8 parts by mass |
| Microcrystalline (mold release agent, melting point: 80° C.) | 7.2 parts by mass |

(Third Polymerization)

| | |
|---|---|
| Styrene (St) | 367.2 parts by mass |
| 2-Ethylhexyl acrylate (2-EHA) | 82.5 parts by mass |
| n-Butyl acrylate (BA) | 82.5 parts by mass |
| Methacrylic acid (MAA) | 34.3 parts by mass |
| Methyl methacrylate (MMA) | 52.5 parts by mass |
| n-Octyl 3-mercaptopropionate | 8.0 parts by mass |

[Preparation of Vinyl Resin Particle Dispersion 4]

Vinyl resin particle dispersion 4 was prepared as in preparation of Vinyl resin particle dispersion 1 except that the monomers, the chain transfer agent, and the mold release agent dissolved in the second polymerization stage were varied as follows.

(Second Polymerization)

| | |
|---|---|
| Styrene (St) | 256.0 parts by mass |
| n-Butyl acrylate | 95.0 parts by mass |
| Methacrylic acid (MAA) | 30.0 parts by mass |
| n-Octyl 3-mercaptopropionate (chain transfer agent) | 3.9 parts by mass |
| Behenyl behenate (mold release agent, melting point: 73° C.) | 145.0 parts by mass |

[Preparation of Toner 1]

Vinyl resin particle dispersion 1 (solid content: 298 parts by mass) and deionized water (2000 parts by mass) were placed into a reactor equipped with a stirrer, a temperature sensor, and a cooling tube. An aqueous solution of 5 mol/L sodium hydroxide was added at room temperature (25° C.) to adjust the pH to 10. The colorant particle dispersion (solid content: 7 parts by mass) was further placed into the reactor, and a solution of magnesium chloride (60 parts by mass) in deionized water (60 parts by mass) was added under stirring at 30° C. over ten minutes. The solution was left for three minutes, and was heated to 80° C. over 60 minutes. After the temperature reached 80° C., Dispersion 1 of crystalline polyester resin particles (solid content: 36.8 parts by mass) was added over 20 minutes. The stirring rate was controlled such that the growth rate of the particle diameter was 0.01 m/min. The crystalline polyester resin particles were grown until those particles had a volume median diameter of 6.0 μm measured with Coulter Multisizer 3 (made by Beckman Coulter, Inc.).

In the next step, the dispersion of amorphous polyester resin particles (solid content: 37.2 parts by mass) was added over thirty minutes. When the supernatant of the reaction solution became transparent, an aqueous solution of sodium chloride (190 parts by mass) in deionized water (760 parts by mass) was added to terminate the growth of the particle diameter. The solution was then heated to 80° C., and was stirred at this temperature to fuse the particles until the average circularity of toner particles reached 0.970. The solution was cooled to 30° C. or less.

The solution was then heated to 50° C. over thirty minutes with stirring, and the temperature was kept for three hours (annealing). The solution was cooled to 30° C. or less. In the next step, solid liquid separation was performed with a basket centrifuge "MARK III type 60×40" (made by Matsumoto Machine Co., Ltd.). Dehydrated toner cake was redispersed in deionized water, and solid liquid separation was performed. This washing cycle of the toner cake was repeated three times. After the washing, the toner cake was dried at 40° C. for 24 hours to yield a particulate toner matrix having a core-shell structure. To the particulate toner matrix (100 parts by mass), hydrophobic silica particles (number average diameter of primary particles: 12 nm, degree of hydrophobizing: 68) (0.6 parts by mass), hydrophobic titanium oxide particles (number average diameter of primary particles: 20 nm, degree of hydrophobizing: 63) (1.0 part by mass), and sol-gel silica (number average diameter of primary particles: 110 nm) (1.0 part by mass) were added, and were mixed with a Henschel mixer (made by NIPPON COKE & ENGINEERING CO., LTD.) having a rotary blade at a circumferential speed of 35 mm/sec at 32° C. for 20 minutes. After the mixing, coarse particles were removed with a sieve having an opening of 45 μm to yield Toner 1.

[Preparation of Toners 2 to 13, 15, and 16]

Toners 2 to 13, 15, and 16 were prepared as in preparation of Toner 1 except that the type and amount of the dispersion of crystalline polyester resin (CPEs) particles, the amount of the dispersion of amorphous polyester (APEs) resin particles, the type and the amount of the vinyl resin particle dispersion, and presence/absence of the annealing step were varied as shown in Table 1.

[Preparation of Toner 14]

A dispersion of amorphous polyester resin particles (solid content: 152.2 parts by mass), a dispersion of a mold release agent (solid content: 52.1 parts by mass), and deionized water (2000 parts by mass) were placed into a reactor equipped with a stirrer, a temperature sensor, and a cooling tube. An aqueous solution of 5 mol/L sodium hydroxide was added at room temperature (25° C.) to adjust the pH to 10. A colorant particle dispersion (solid content: 7 parts by mass) was further placed into the reactor, and a solution of magnesium chloride (60 parts by mass) in deionized water (60 parts by mass) was added under stirring at 30° C. over ten minutes. After the solution was left for three minutes, the solution was heated to 80° C. over sixty minutes. After the temperature reached 80° C., Dispersion 1 of crystalline polyester resin particles (solid content: 130.2 parts by mass) was added over forty minutes. The stirring rate was controlled such that the growth rate of the particle diameter was 0.01 pun/min. Particles were grown until the particles had a volume median diameter of 6.0 μm measured with Coulter Multisizer 3 (made by Beckman Coulter, Inc.).

In the next step, the dispersion of amorphous polyester resin particles (solid content: 37.5 parts by mass) was added over thirty minutes. After the supernatant of the reaction solution became transparent, an aqueous solution of sodium chloride (190 parts by mass) in deionized water (760 parts by mass) was added to terminate the growth of the particle diameter. In the next step, the solution was heated to 80° C., and was stirred at this temperature to fuse the particles until the average circularity of toner particles reached 0.970. The solution was cooled to 30° C. or less.

The solution was annealed as in Toner 1. The solution was cooled to 30° C. or less. In the next step, solid liquid separation was performed. Dehydrated toner cake was redispersed in deionized water, and solid liquid separation was performed. This washing cycle of the toner case was repeated three times. After the washing, the toner cake was dried at 40° C. for 24 hours to yield toner particles. To the toner particles (100 parts by mass), hydrophobic silica particles (number average diameter of primary particles: 12 nm, degree of hydrophobizing: 68) (0.6 parts by mass), hydrophobic titanium oxide particles (number average diameter of primary particles: 20 nm, degree of hydrophobizing: 63) (1.0 part by mass), and sol-gel silica (number average diameter of primary particles: 110 nm) (1.0 part by mass) were added, and were mixed with a Henschel mixer (made by NIPPON COKE & ENGINEERING CO., LTD.) having a rotary blade at a circumferential speed of 35 mm/sec at 32° C. for 20 minutes. After the mixing, coarse particles were removed with a sieve having an opening of 45 μm to yield Toner 14.

TABLE 1

| Toner No. | Dispersion of CPEs resin particles No. | Amount (Solid content) [Parts by mass] | Amount of dispersion of APEs resin particles (Solid content) [Parts by mass] | Dispersion of vinyl resin particles or mold release agent particles Type | Amount (Solid content) [Parts by mass] | Proportion (Solid content) [Parts by mass] St-Ac resin | Mold release agent | APEs | CPEs | CPEs Content [Parts by mass] | Annealing | Notes |
|---|---|---|---|---|---|---|---|---|---|---|---|---|
| 1 | 1 | 36.8 | 37.2 | Dispersion of vinyl resin particles 1 | 298.0 | 70.50 | 9.60 | 10.00 | 9.90 | 49.75 | Annealed | Inventive |
| 2 | 2 | 30.9 | 37.2 | Dispersion of vinyl resin particles 2 | 303.9 | 72.10 | 9.60 | 10.00 | 8.30 | 45.36 | Annealed | Inventive |
| 3 | 1 | 55.8 | 37.2 | Dispersion of vinyl resin particles 1 | 279.0 | 66.00 | 9.00 | 10.00 | 15.00 | 60.00 | Annealed | Inventive |
| 4 | 1 | 31.6 | 37.2 | Dispersion of vinyl resin particles 1 | 303.2 | 71.72 | 9.78 | 10.00 | 8.50 | 45.95 | Annealed | Inventive |
| 5 | 1 | 24.9 | 37.2 | Dispersion of vinyl resin particles 1 | 309.9 | 73.30 | 10.00 | 10.00 | 6.70 | 40.12 | Annealed | Inventive |
| 6 | 3 | 36.8 | 37.2 | Dispersion of vinyl resin particles 1 | 298.0 | 70.50 | 9.60 | 10.00 | 9.90 | 49.75 | Annealed | Inventive |
| 7 | 4 | 44.6 | 37.2 | Dispersion of vinyl resin particles 1 | 290.2 | 68.64 | 9.36 | 10.00 | 12.00 | 54.55 | Annealed | Inventive |
| 8 | 1 | 74.4 | 74.4 | Dispersion of vinyl resin particles 1 | 223.2 | 52.80 | 7.20 | 20.00 | 20.00 | 50.00 | Annealed | Inventive |
| 9 | 1 | 26.0 | 18.6 | Dispersion of vinyl resin particles 1 | 327.4 | 77.44 | 10.56 | 5.00 | 7.00 | 58.33 | Annealed | Inventive |
| 10 | 5 | 56.2 | 37.2 | Dispersion of vinyl resin particles 3 | 278.6 | 65.91 | 8.99 | 10.00 | 15.10 | 60.16 | Annealed | Inventive |
| 11 | 6 | 36.8 | 37.2 | Dispersion of vinyl resin particles 1 | 298.0 | 70.49 | 9.61 | 10.00 | 9.90 | 49.75 | Annealed | Inventive |
| 12 | 1 | 67.0 | 37.2 | Dispersion of vinyl resin particles 1 | 267.8 | 63.36 | 8.64 | 10.00 | 18.00 | 64.29 | Annealed | Comparative |
| 13 | 1 | 18.6 | 37.2 | Dispersion of vinyl resin particles 1 | 316.2 | 74.80 | 10.20 | 10.00 | 5.00 | 33.33 | Not annealed | Comparative |
| 14 | 1 | 130.2 | 189.7 | Dispersion of mold release agent particles 1 | 52.1 | 0.00 | 14.00 | 51.00 | 35.00 | 40.70 | Annealed | Comparative |
| 15 | 1 | 36.8 | 37.2 | Dispersion of vinyl resin particles 4 | 298.0 | 70.49 | 9.61 | 10.00 | 9.90 | 49.75 | Annealed | Comparative |
| 16 | 5 | 46.5 | 37.2 | Dispersion of vinyl resin particles 1 | 288.3 | 68.20 | 9.30 | 10.00 | 12.50 | 55.56 | Not annealed | Comparative |

[Storage Moduli of Toners 1 to 16]

Based on the melting point ($T_m$° C. derived from the crystalline resin, Toners 1 to 16 were subjected to measurement of the storage moduli ($G'_{Tm-10}(t)$ and $G'_{Tm-20}(t)$) after each toner was left at ($T_m$−10)° C. and ($T_m$−20°) C. respectively, for three hours and the storage modulus $G'_0(t)$ before the toner was left. The storage modulus was measured according to the following procedure. From the results of measurement, temperatures $t_0$ to $t_3$ each having a modulus of $1.0\times10^6$ Pa were determined. From the results of measurement of the storage moduli, the temperature having the maximum ratio $G'_{Tm-10}(t)/G'_{Tm-20}(t)$ was determined, and was defined as a temperature x having the maximum difference between the storage moduli $G'_{Tm-10}(t)$ and $G'_{Tm-20}(t)$.

The results of measurement are shown in Tables 2 and 3. The maximum and minimum values of the ratios $G'_{Tm-20}(t)/G'_0(t)$ and $G'_{Tm-10}(t)/G'_0(t)$ in the temperature range A for measurement where the storage modulus $G'_0(t)$ measured before the toner was left was $1.0\times10^6$ Pa or more are shown in Table 3.

A weighed sample (0.2 g) of a toner containing an external additive (after or before the toner was left) was molded under a pressure of 25 MPa with a compression molding machine to prepare a cylindrical pellet having a diameter of 10 mm.

A cooling operation was performed at a frequency of 1 Hz with a rheometer (made by TA Instruments-Waters LLC: ARES G2) using a set of an upper parallel plate having a diameter of 8 mm and a lower parallel plate having a diameter of 20 mm. The sample was placed between the plates at 100° C. The gap was set at 1.4 mm once, and the sample protruding from the gap between the plates was scraped, and the gap was set at 1.2 mm. While an axial force was being applied, the sample was cooled to any temperature, and was left to stand for three hours. The sample was cooled to a measurement starting temperature of 30° C., and the axial force was released. The storage modulus (G') was measured while the sample was heated from 30° C. to 150° C. at a heating rate of 3° C./min. The detailed conditions for measurement are listed:

Frequency: 1 Hz

Ramp rate: 3° C./min

Axicial force: 0 g, sensitivity: 10 g

Initial strain: 3.0%, Strain adjust: 30.0%, Minimum strain: 0.01%, Maximum strain: 10.0%

Minimum torque: 1 g·cm, Maximum torque: 80 g·cm

Sampling interval: 1.0° C./pt (Measurement of Melting Point ($T_m$) Derived from Crystalline Resin)

A toner sample (5 mg) containing an external additive was sealed in an aluminum pan KIT NO. B0143013. The aluminum pan was placed in a sample holder of a thermal analyzer Diamond DSC (made by PerkinElmer Inc.), and was heated. The peak top temperature of the endothermic curve derived from the crystalline resin heated from 0° C. to 100° C. at a heating rate of 10° C./min in a first heating cycle was defined as the melting point ($T_m$) derived from the crystalline resin. These toners had a peak having the pattern (i-ii) illustrated in FIG. 2B.

The melting point ($T_m$) derived from the crystalline resin was equal to $T_m$ shown in Table 2.

TABLE 2

| Toner | $T_m$ | Temperature causing $1.0 \times 10^6$ Pa [° C.] | | | Expression (4a) $\lvert t_0 - t_1 \rvert$ | Expression (4b) $\lvert t_0 - t_2 \rvert$ | |
|---|---|---|---|---|---|---|---|
| No. | [° C.] | $t_0$ | $t_1$ | $t_2$ | [° C.] | [° C.] | Notes |
| 1 | 72 | 70.5 | 71.9 | 70.3 | 1.4 | 0.2 | Inventive |
| 2 | 75 | 70.5 | 72.0 | 70.4 | 1.5 | 0.1 | Inventive |
| 3 | 72 | 68.2 | 70.0 | 68.4 | 1.8 | 0.2 | Inventive |
| 4 | 72 | 73.0 | 73.3 | 73.4 | 0.3 | 0.4 | Inventive |
| 5 | 72 | 74.0 | 75.3 | 74.3 | 1.3 | 0.3 | Inventive |
| 6 | 60 | 63.0 | 63.2 | 63.0 | 0.2 | 0.0 | Inventive |
| 7 | 66 | 66.0 | 67.3 | 66.4 | 1.3 | 0.4 | Inventive |
| 8 | 72 | 61.1 | 62.3 | 61.5 | 1.2 | 0.4 | Inventive |
| 9 | 72 | 73.5 | 74.0 | 73.6 | 0.5 | 0.1 | Inventive |
| 10 | 58 | 62.0 | 62.8 | 62.7 | 0.8 | 0.7 | Inventive |
| 11 | 80 | 76.0 | 83.0 | 79.0 | 7.0 | 3.0 | Inventive |
| 12 | 72 | 63.5 | 64.4 | 63.9 | 0.9 | 0.4 | Comparative |
| 13 | 72 | 74.0 | 74.4 | 74.2 | 0.4 | 0.2 | Comparative |
| 14 | 72 | 68.0 | 73.5 | 73.2 | 5.5 | 5.2 | Comparative |
| 15 | 72 | 71.0 | 72.3 | 71.5 | 1.3 | 0.5 | Comparative |
| 16 | 58 | 64.0 | 64.1 | 64.1 | 0.1 | 0.1 | Comparative |

TABLE 3

| Toner | Expression (2a) x | $G'_{Tm-20}$ (x) | $G'_{Tm-10}$ (x) | $G'_{Tm-10}$ (x)/ | $<G'_{Tm-20}(t)/G'_0(t)$ | | Expression (1a) $G'_0(t) <$ | $<G'_{Tm-10}(t)/G'_0(t)$ | | Expression (1b) $G'_0(t) <$ | |
|---|---|---|---|---|---|---|---|---|---|---|---|
| No. | [° C.] | [$\times 10^8$ Pa] | [$\times 10^8$ Pa] | $G'_{Tm-20}$ (x) | Minimum | Maximum | $G'_{Tm-10}$ (t) | Minimum | Maximum | $G'_{Tm-20}$ (t) | Notes |
| 1 | 55 | 1.56895 | 1.725845 | 1.10 | 1.15 | 4.98 | ○ | 1.20 | 5.48 | ○ | Inventive |
| 2 | 57 | 1.504144 | 1.804973 | 1.20 | 1.16 | 5.03 | ○ | 1.22 | 6.04 | ○ | Inventive |
| 3 | 58 | 1.616611 | 2.43127 | 1.50 | 1.13 | 6.65 | ○ | 1.24 | 10.00 | ○ | Inventive |
| 4 | 60 | 1.99204 | 2.49005 | 1.25 | 1.08 | 2.40 | ○ | 1.14 | 3.00 | ○ | Inventive |
| 5 | 62 | 2.22407 | 2.335274 | 1.05 | 1.02 | 1.80 | ○ | 1.05 | 1.89 | ○ | Inventive |
| 6 | 50 | 1.02649 | 1.08714 | 1.06 | 1.02 | 2.83 | ○ | 1.03 | 3.00 | ○ | Inventive |
| 7 | 54 | 1.40379 | 1.795306 | 1.28 | 1.17 | 5.00 | ○ | 1.22 | 6.39 | ○ | Inventive |
| 8 | 50 | 1.09896 | 1.538544 | 1.40 | 1.22 | 6.00 | ○ | 1.26 | 8.40 | ○ | Inventive |
| 9 | 64 | 2.53033 | 2.60624 | 1.03 | 1.06 | 1.90 | ○ | 1.08 | 1.96 | ○ | Inventive |
| 10 | 55 | 1.99998 | 2.03998 | 1.02 | 1.20 | 13.00 | ○ | 1.25 | 13.26 | ○ | Inventive |
| 11 | 65 | 1.42002 | 1.760825 | 1.24 | 1.20 | 7.00 | ○ | 1.21 | 8.68 | ○ | Inventive |
| 12 | 56 | 1.6009 | 4.8027 | 3.00 | 1.12 | 5.00 | ○ | 1.13 | 15.00 | ○ | Comparative |
| 13 | 58 | 1.42002 | 1.462621 | 1.03 | 1.00 | 1.10 | x | 0.98 | 1.08 | x | Comparative |
| 14 | 62 | 1.2993 | 1.55916 | 1.20 | 1.12 | 5.40 | ○ | 1.20 | 6.48 | ○ | Comparative |
| 15 | 68 | 0.005851 | 0.08122 | 13.88 | 1.10 | 8.00 | ○ | 1.12 | 14.02 | ○ | Comparative |
| 16 | 48 | 1.91138 | 1.91138 | 1.00 | 1.00 | 1.10 | x | 1.00 | 1.10 | x | Comparative |

[Evaluation of Toners 1 to 16]

Toners 1 to 16 were evaluated according to the following procedures. The results are shown in Table 4.

<Heat-Resistant Storage Characteristics of Toner>

A toner (0.5 g) was placed into a 10 mL glass bottle having an inner diameter of 21 mm. The glass bottle was sealed, and was shaken 600 times at room temperature with a shaker "Tap Denser KYT-2000" (made by Seishin Enterprise Co., Ltd.). The glass bottle was opened, and was left under an environment at a temperature of 55° C. and a humidity of 35% RH for two hours. In the next step, the total amount of toner was carefully placed on a 48-mesh sieve (opening: 350 μm) so as to keep the toner aggregates. The sieve was placed on a "powder tester" (made by Hosokawa Micron Corporation), and was fixed with a press bar and a knob nut. The intensity of vibration was adjusted so as to have a moving width of 1 mm. The sieve was vibrated for ten seconds. The amount of the toner passing through the sieve was measured to calculate the proportion (mass %) of the amount of the toner passing through the sieve from Expression (A). The heat-resistant storage characteristics of the toner were evaluated based on the sieve passing rate of the toner. A sieve passing rate of 80% or more was determined as acceptable.

Sieve passing rate (%)=[((mass(g) of toner placed on sieve)−(mass(g) of remaining toner on sieve))/(mass(g) of toner placed on sieve)]×100 Expression (A):

(Criteria for Evaluation of Heat-Resistant Storage Characteristics of Toner)

A: 90% or more (toner has superior heat-resistant storage characteristics)

B: 85% or more and less than 90% (toner has excellent heat-resistant storage characteristics)

C: 80% or more and less than 85% (toner has satisfactory heat-resistant storage characteristics)

F: less than 80% (toner has poor heat-resistant storage characteristics and cannot be used)

<Low-Temperature Fixing Characteristics and Variation in Fixing Temperature During Exposure to High Temperature>

The image forming apparatus used was a commercially available full-color multifunction machine "bizhub C754" (made by KONICA MINOLTA, INC.) modified such that the surface temperatures of an upper fixing belt and a lower fixing roller were variable. A solid image with a toner density of 11.3 g/m$^2$ was output onto size A4 plain paper (basis weight: 80 g/m$^2$) under conditions of a nip width of 11.2 mm for a fixing time of 34 msec at a fixing pressure of 133 kPa and a fixing temperature of 100 to 200° C. This output test was repeated while the fixing temperature was gradually varied by an increment of 5° C.

The lowest fixing temperature at which no contamination in images caused by fixing off-setting was visually observed was defined as the lowest fixing temperature. A developer was exposed to a temperature of 50° C. and a humidity of 40% for 24 hours, and the same evaluation was performed.

The variation in the lowest fixing temperature was defined as the variation in fixing temperature during exposure to high temperature.

(Criteria for Evaluation of Low-Temperature Fixing Characteristics)

A: lowest fixing temperature of less than 135° C. (toner has superior low-temperature fixing characteristics)

B: lowest fixing temperature of 135° C. or more and less than 145° C. (toner has excellent low-temperature fixing characteristics)

C: lowest fixing temperature of 145° C. or more and less than 155° C. (toner has satisfactory low-temperature fixing characteristics)

F: lowest fixing temperature of 155° C. or more (toner has poor low-temperature fixing characteristics, and cannot be used)

(Criteria for Evaluation of Variation in Fixing Temperature During Exposure to High Temperature (Reduction in Variation in Fixing))

A: Variation in fixing temperature during exposure to high temperature is less than 3° C. (toner has superior environmental stability of fixing performance).

B: Variation in fixing temperature during exposure to high temperature is 3° C. or more and less than 5° C. (toner has excellent environmental stability of fixing performance).

C: Variation in fixing temperature during exposure to high temperature is 5° C. or more and less than 7° C. (toner has satisfactory environmental stability of fixing performance).

F: Variation in fixing temperature during exposure to high temperature is 7° C. or more (toner has poor environmental stability of fixing performance, and cannot be used).

<Bleed-Out of Foreign Substances Caused by Exposure to High Temperature>

A developer was exposed to conditions at a temperature of 50° C. and a humidity of 40% for 24 hours, and was photographed with a transmission electron microscope "JSM-7401F" (made by JEOL, Ltd.) on the following conditions:

Mode for measurement: SE mode, LEI

Accelerating voltage: 2 kV

Emission current: 20 μA

Working distance: 8 mm

Magnification: ×1000

Data size: 1280×1024

The images of the developer before and after exposure were compared to verify whether foreign substances bled out from the insides of toner particles to the surfaces thereof.

(Criteria for Evaluation of Bleed-Out of Foreign Substances Caused by Exposure to High Temperature)

A: Toner particles have no foreign substances observed in one field (toner has superior environmental stability).

B: Some toner particles have the bleed-out of one or two foreign substances observed in one field (toner has excellent environmental stability).

C: Some toner particles have the bleed-out of three to nine foreign substances observed in one field (toner has satisfactory environmental).

F: Some toner particles have the bleed-out of ten or more foreign substances observed in one field (toner has poor environmental stability, and cannot be used).

TABLE 4

| Toner No. | Low-temperature fixing characteristics (The lowest fixing temperature) Before exposure [° C.] | After exposure [° C.] | Variation [° C.] | Low-temperature fixing characteristics | Variation in fixing temperature during exposure to high temperature | Bleed-out caused by exposure to high temperature | Heat-resistant storage characteristics (Sieve passing rate) | Notes |
|---|---|---|---|---|---|---|---|---|
| 1 | 130 | 132 | 2 | A | A | A | 91 | Inventive |
| 2 | 138 | 141 | 3 | B | B | B | 95 | Inventive |
| 3 | 127 | 133 | 6 | A | C | C | 88 | Inventive |
| 4 | 135 | 139 | 4 | B | B | C | 93 | Inventive |
| 5 | 145 | 146 | 1 | C | A | A | 87 | Inventive |
| 6 | 122 | 123 | 1 | A | A | A | 83 | Inventive |
| 7 | 124 | 128 | 4 | A | B | C | 90 | Inventive |
| 8 | 125 | 130 | 5 | A | C | C | 88 | Inventive |
| 9 | 137 | 138 | 1 | B | A | A | 95 | Inventive |
| 10 | 118 | 119 | 1 | A | A | C | 80 | Inventive |
| 11 | 154 | 157 | 3 | C | B | C | 95 | Inventive |
| 12 | 120 | 130 | 10 | A | F | F | 87 | Comparative |
| 13 | 145 | 146 | 1 | C | A | A | 79 | Comparative |
| 14 | 155 | 158 | 3 | F | B | B | 93 | Comparative |
| 15 | 130 | 140 | 10 | A | F | F | 93 | Comparative |
| 16 | 120 | 121 | 1 | A | A | A | 75 | Comparative |

SUMMARY

These results show that the present invention can provide an electrostatic charge image developing toner containing a crystalline resin, the toner having superior low-temperature fixing characteristics and heat-resistant storage characteristics, and having stable low-temperature fixing characteristics of the toner and reduced bleed-out of the crystalline material during long-term storage of the toner at high temperature.

Toners 1 to 16 had the maximum difference between the storage modulus $G'_{Tm-10}(t)$ and the storage modulus $G'_0(t)$ and the maximum difference between the storage modulus $G'_{Tm-20}(t)$ and the storage modulus $G'_0(t)$ if the difference between the storage moduli $G'_{Tm-10}(t)$ and $G'_{Tm-20}(t)$ is maximum in the temperature range A for measurement (i.e., t° C.=x° C.).

Although embodiments of the present invention have been described and illustrated in detail, it is clearly understood that the same is by way of illustration and example only and is not to be taken by way of limitation, and the scope of the present invention should be interpreted by terms of the appended claims.

What is claimed is:

1. An electrostatic charge image developing toner comprising:

a particulate toner matrix containing a binder resin, and an external additive, wherein the binder resin comprises an amorphous polyester resin, a crystalline resin, and an amorphous vinyl resin, and a storage modulus $G'_0(t)$ measured before the toner is left and storage moduli $G'_{Tm-10}(t)$ and $G'_{Tm-20}(t)$ measured after the toner is left for three hours at temperatures ($T_m$-10°) C. and ($T_m$-20°) C., respectively, based on a melting point ($T_m$° C.) derived from the crystalline resin satisfy the relations represented by Expressions (1a), (1b), and (2a) in a temperature range A for measurement where the storage modulus $G'_0(t)$ is $1.0\times10^6$ Pa or more:

$$G'_0(t)<G'_{Tm-10}(t) \quad \text{Expression (1a):}$$

$$G'_0(t)<G'_{Tm-20}(t) \quad \text{Expression (1b):}$$

$$G'_{Tm-10}(x)/G'_{Tm-20}(x)\leq1.5 \quad \text{Expression (2a):}$$

where t represents any temperature (° C.) for measurement in the temperature range A for measurement; and x represents the temperature (° C.) for measurement having a maximum difference between the storage moduli $G'_{Tm-10}(t)$ and $G'_{Tm-20}(t)$.

2. The electrostatic charge image developing toner according to claim 1, wherein the content of the crystalline resin in the total amount of the amorphous polyester resin and the crystalline resin is more than 40 mass % and 60 mass % or less.

3. The electrostatic charge image developing toner according to claim 1, wherein the content of the amorphous vinyl resin in the binder resin is 50 mass % or more.

4. The electrostatic charge image developing toner according to claim 1, wherein the storage moduli $G'_0(t)$, $G'_{Tm-10}(t)$, and $G'_{Tm-20}(t)$ satisfy the relations represented by Expressions (3a) and (3b) in the temperature range A for measurement where the storage modulus $G'_0(t)$ is $1.0\times10^6$ Pa or more:

$$1<G'_{Tm-10}(t)/G'_0(t)\leq10 \quad \text{Expression (3a):}$$

$$1<G'_{Tm-20}(t)/G'_0(t)\leq10 \quad \text{Expression (3b).}$$

5. The electrostatic charge image developing toner according to claim 1, wherein the storage moduli $G'_0(t)$, $G'_{Tm-10}(t)$, and $G'_{Tm-20}(t)$ satisfy the relations represented by Expressions (4a) and (4b) where temperatures at which the storage moduli $G'_0(t)$, $G'_{Tm-10}(t)$, and $G'_{Tm-20}(t)$ is $1.0\times10^6$ Pa are defined as $t_0$° C., $t_1$° C., and $t_2$° C., respectively:

$$|t_0-t_1|\leq2° \text{ C.} \quad \text{Expression (4a):}$$

$$|t_0-t_2|\leq2° \text{ C.} \quad \text{Expression (4b).}$$

6. The electrostatic charge image developing toner according to claim 1, wherein storage moduli at temperatures having a maximum difference between the storage modulus $G'_{Tm-10}(t)$ and the storage modulus $G'_0(t)$ and a maximum difference between the storage modulus $G'_{Tm-20}(t)$ and the storage modulus $G'_0(t)$ are in the range of $1.0\times10^8$ to $3.0\times10^8$ Pa in the temperature range A for measurement where the storage modulus $G'_0(t)$ is $1.0\times10^6$ Pa or more.

7. The electrostatic charge image developing toner according to claim 1, wherein the relation represented by Expression ($G'_{Tm-10}(x)/G'_{Tm-20}(x)$) in the left side of Expression (2a) satisfies the relation represented by Expression (2b):

$$G'_{Tm-10}(x)/G'_{Tm-20}(x)\leq1.25 \quad \text{Expression (2b).}$$

8. The electrostatic charge image developing toner according to claim 1, wherein the relation represented by Expression ($G'_{Tm-10}(x)/G'_{Tm-20}(x)$) in the left side of Expression (2a) satisfies the relation represented by Expression (2c):

$$G'_{Tm-10}(x)/G'_{Tm-20}(x)\leq1.1 \quad \text{Expression (2c).}$$

9. An electrostatic charge image developing toner according to claim 1, wherein the particulate toner matrix has a core-shell structure.

10. The electrostatic charge image developing toner according to claim 1, wherein the melting point $T_m$ is in the range of 55 to 80° C.

11. The electrostatic charge image developing toner according to claim 1, wherein the content of the crystalline resin in the particulate toner matrix is in the range of 5 to 20 mass %.

12. The electrostatic charge image developing toner according to claim 1, wherein the crystalline resin comprises a crystalline polyester resin.

13. The electrostatic charge image developing toner according to claim 12, wherein the crystalline polyester resin comprises a hybrid crystalline polyester resin of at least a crystalline polyester polymer segment and a different polymer segment that are chemically bonded.

* * * * *